US010076912B2

(12) United States Patent
Kanegae

(10) Patent No.: US 10,076,912 B2
(45) Date of Patent: Sep. 18, 2018

(54) LIQUID EJECTING HEAD UNIT AND LIQUID EJECTING APPARATUS

(71) Applicant: SEIKO EPSON CORPORATION, Tokyo (JP)

(72) Inventor: Takahiro Kanegae, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/484,442

(22) Filed: Apr. 11, 2017

(65) Prior Publication Data

US 2017/0305155 A1 Oct. 26, 2017

(30) Foreign Application Priority Data

Apr. 21, 2016 (JP) ..... 2016-085555

(51) Int. Cl.

| | |
|---|---|
| ***B41J 2/175*** | (2006.01) |
| ***B41J 2/19*** | (2006.01) |
| ***B41J 2/18*** | (2006.01) |
| *B41J 2/045* | (2006.01) |

(52) U.S. Cl.

CPC ..... *B41J 2/17556* (2013.01); *B41J 2/18* (2013.01); *B41J 2/19* (2013.01); *B41J 2/04581* (2013.01); *B41J 2/175* (2013.01); *B41J 2202/07* (2013.01)

(58) Field of Classification Search

CPC ... B41J 2/17556; B41J 2/19; B41J 2/18; B41J 2202/07; B41J 2/04581; B41J 2/175

See application file for complete search history.

(56) References Cited

U.S. PATENT DOCUMENTS

| | | | | |
|---|---|---|---|---|
| 5,936,650 | A * | 8/1999 | Ouchida | B41J 2/175 347/89 |
| 5,946,015 | A | 8/1999 | Courtney | |
| 2008/0049084 | A1 | 2/2008 | Katada | |
| 2010/0188453 | A1 | 7/2010 | Murakami et al. | |
| 2013/0057623 | A1 | 3/2013 | Hanagami | |

FOREIGN PATENT DOCUMENTS

| | | |
|---|---|---|
| EP | 2 759 408 | 7/2014 |
| JP | 2010-167732 | 8/2010 |
| JP | 2011-183679 | 9/2011 |
| WO | 2013-042457 | 3/2013 |

OTHER PUBLICATIONS

European Search Report issued in Application No. 17167551 dated Sep. 4, 2017.

* cited by examiner

*Primary Examiner* — Geoffrey Mruk
(74) *Attorney, Agent, or Firm* — Workman Nydegger

(57) ABSTRACT

A liquid ejecting head unit includes a drive unit for ejecting a liquid inside a pressure chamber from a nozzle opening which communicates with the pressure chamber, a common liquid chamber which communicates with a plurality of the pressure chambers, a bubble return flow path for communicating with the common liquid chamber and discharging bubbles inside the common liquid chamber, a confluence point which communicates with a plurality of the bubble return flow paths, a collective return flow path for communicating with the confluence point and discharging the bubbles inside the plurality of bubble return flow paths, and a one-way valve which is provided part way down the bubble return flow path.

20 Claims, 15 Drawing Sheets

LIQUID EJECTING HEAD UNIT AND LIQUID EJECTING APPARATUS

CROSS-REFERENCE TO RELATED APPLICATIONS

The entire disclosure of Japanese Patent Application No. 2016-085555, filed Apr. 21, 2016 is incorporated by reference herein.

BACKGROUND

1. Technical Field

The present invention relates to a liquid ejecting head unit and a liquid ejecting apparatus. In particular, the invention relates to an ink jet recording head unit which ejects an ink as a liquid, and an ink jet recording apparatus.

2. Related Art

For example, an ink jet recording head unit which discharges an ink from a plurality of nozzle openings forming a nozzle row by utilizing a pressure change in a pressure chamber due to a displacement of a piezoelectric element which is a pressure generating unit is known as a typical example of the liquid ejecting head unit.

The ink jet recording head unit is provided with a manifold which is common to the plurality of nozzle openings, and the ink is supplied to the manifold from an ink supply unit such as an ink cartridge. Bubbles may be contained in the ink, and there is a case in which the ink enters the pressure chamber from the manifold.

A liquid ejecting head unit which is provided with a bubble storage portion in the manifold in order to suppress the entering of bubbles into the pressure chamber in this manner is proposed (for example, refer to JP-A-2011-183679). Since the bubbles which enter the manifold are stored in the bubble storage portion which is provided in a ceiling portion of the manifold, the entry of the bubbles into the pressure chamber is suppressed. As a result, pressure loss due to bubbles in the inner portion of the pressure chamber is reduced, and defective ejection of the ink is reduced.

In the liquid ejecting head unit described above, in order to discharge bubbles which are stored in the bubble storage portion of the manifold to the outside, for example, the bubbles must be drawn together with the ink using a negative pressure from the nozzle opening side. Therefore, the consumption amount of ink which is not used in the printing increases.

This problem is present not only in an ink jet recording head unit, but also in the same manner in a liquid ejecting head unit that ejects a liquid other than an ink.

SUMMARY

An advantage of some aspects of the invention is to provide a liquid ejecting head unit and a liquid ejecting apparatus which are capable of discharging bubbles which are inside a manifold to the outside.

Aspect 1

According to an aspect of the invention, there is provided a liquid ejecting head unit which includes a drive unit for ejecting a liquid inside a pressure chamber from a nozzle opening which communicates with the pressure chamber, a common liquid chamber which communicates with a plurality of the pressure chambers, a bubble return flow path for communicating with the common liquid chamber and discharging bubbles inside the common liquid chamber, a confluence point which communicates with a plurality of the bubble return flow paths, a collective return flow path for communicating with the confluence point and discharging the bubbles inside the plurality of bubble return flow paths, and a one-way valve which is provided part way down the bubble return flow path.

In this aspect, since the one-way valve is provided in each of the bubble return flow paths, the flowing back of the bubbles which are discharged from each of the common liquid chambers to the bubble return flow path into the inner portion of the other common liquid chambers is suppressed, and it is possible to efficiently discharge the bubbles in the common liquid chambers to the outside.

Aspect 2

In the liquid ejecting head unit, it is preferable that the liquid ejecting head unit further include a gas permeable portion which is provided part way down the bubble return flow path, allows gas to permeate, and does not allow a liquid to permeate. Accordingly, it is possible to more reliably discharge the bubbles inside the common liquid chamber to the outside by causing the bubbles to permeate the gas permeable portion and to be discharged to the outside.

Aspect 3

In the liquid ejecting head unit, it is preferable that a ceiling of the common liquid chamber be inclined toward the bubble return flow path. Accordingly, it is possible to more reliably discharge the bubbles from the common liquid chamber to the bubble return flow path.

Aspect 4

In the liquid ejecting head unit, it is preferable that the liquid ejecting head unit further include an upstream side bubble return flow path for communicating with the common liquid chamber and discharging bubbles inside an upstream flow path which is closer to an upstream side than the common liquid chamber, and the confluence point communicate with the upstream side bubble return flow path. Accordingly, it is possible to discharge the bubbles which are contained in the liquid in the upstream flow path to the outside.

Aspect 5

In the liquid ejecting head unit, it is preferable that a minimum value of flow path resistance of a flow path from the nozzle opening to an exit via the bubble return flow path be smaller than a meniscus withstand pressure of the nozzle opening. Accordingly, it is possible to reduce the amount of the liquid which is discharged from the nozzle opening when pressurizing the liquid and filling the common liquid chamber with the liquid.

Aspect 6

According to another aspect of the invention, there is provided a liquid ejecting apparatus which is provided with the liquid ejecting head unit.

In this aspect, it is possible to realize a liquid ejecting apparatus which is capable of discharging the bubbles inside the common liquid chamber to the outside.

Aspect 7

In the liquid ejecting apparatus, it is preferable that the liquid ejecting apparatus further include an open-close valve which communicates with the collective return flow path, and a liquid pump mechanism which pressurizes an inside of the common liquid chamber, and the open-close valve be closed when discharging a liquid inside the common liquid chamber from the nozzle opening using the liquid pump mechanism. Accordingly, since the open-close valve is closed during the pressurized cleaning, since it is possible to discharge the pressurized liquid to the nozzle opening without discharging the pressurized liquid from the collective return flow path to the outside of the open-close valve, it is possible to effectively discharge liquid from the nozzle opening.

Aspect 8

In the liquid ejecting apparatus, it is preferable that, during an initial filling, the open-close valve be opened, and bubbles be discharged via the bubble return flow path, and after the initial filling, the open-close valve be closed. Accordingly, it is possible efficiently fill a flow path such as the common liquid chamber with the liquid.

Aspect 9

In the liquid ejecting apparatus, it is preferable that the liquid ejecting head unit further include an inlet which is connected to a liquid supply unit which is provided in the liquid ejecting apparatus and introduces a liquid into the common liquid chamber, and a discharge port which is connected to an open-close valve, which is provided in the liquid ejecting apparatus and communicates with the collective return flow path, and discharges the liquid from the collective return flow path, and a number of the discharge ports be smaller than a number of the inlets. Accordingly, it is possible to simplify the attachment and detachment of the liquid ejecting unit in relation to the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Detailed description will be given of an embodiment of the invention. In the present embodiment, an ink jet recording head unit (hereinafter also simply referred to as a head unit) which discharges an ink will be described as an example of a liquid ejecting head unit. An ink jet recording apparatus which is provided with a head unit will be described as an example of a liquid ejecting apparatus.

Figure 1:
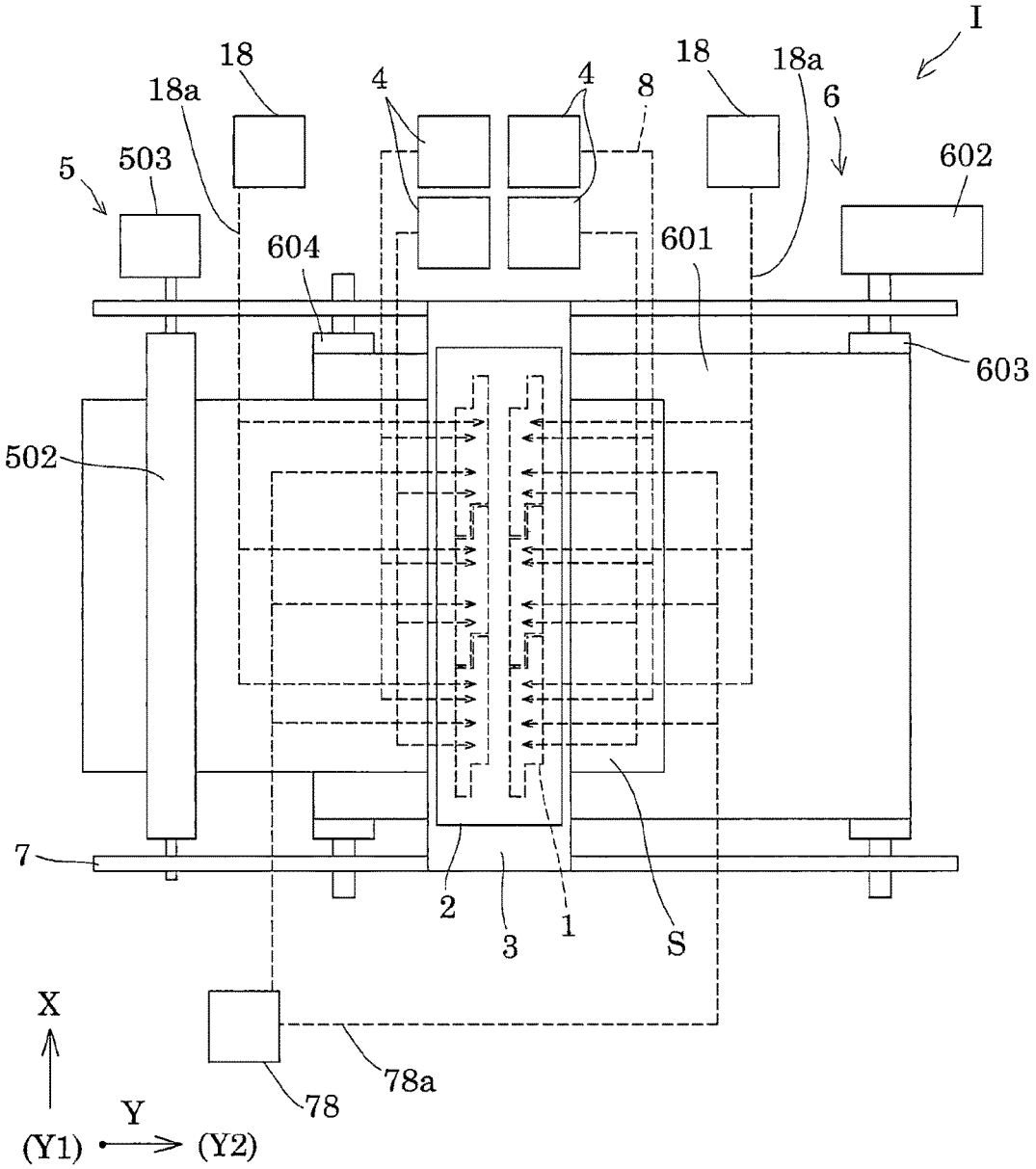
FIG. 1 is a top surface diagram illustrating the schematic configuration of an ink jet recording apparatus.
Figure 2:
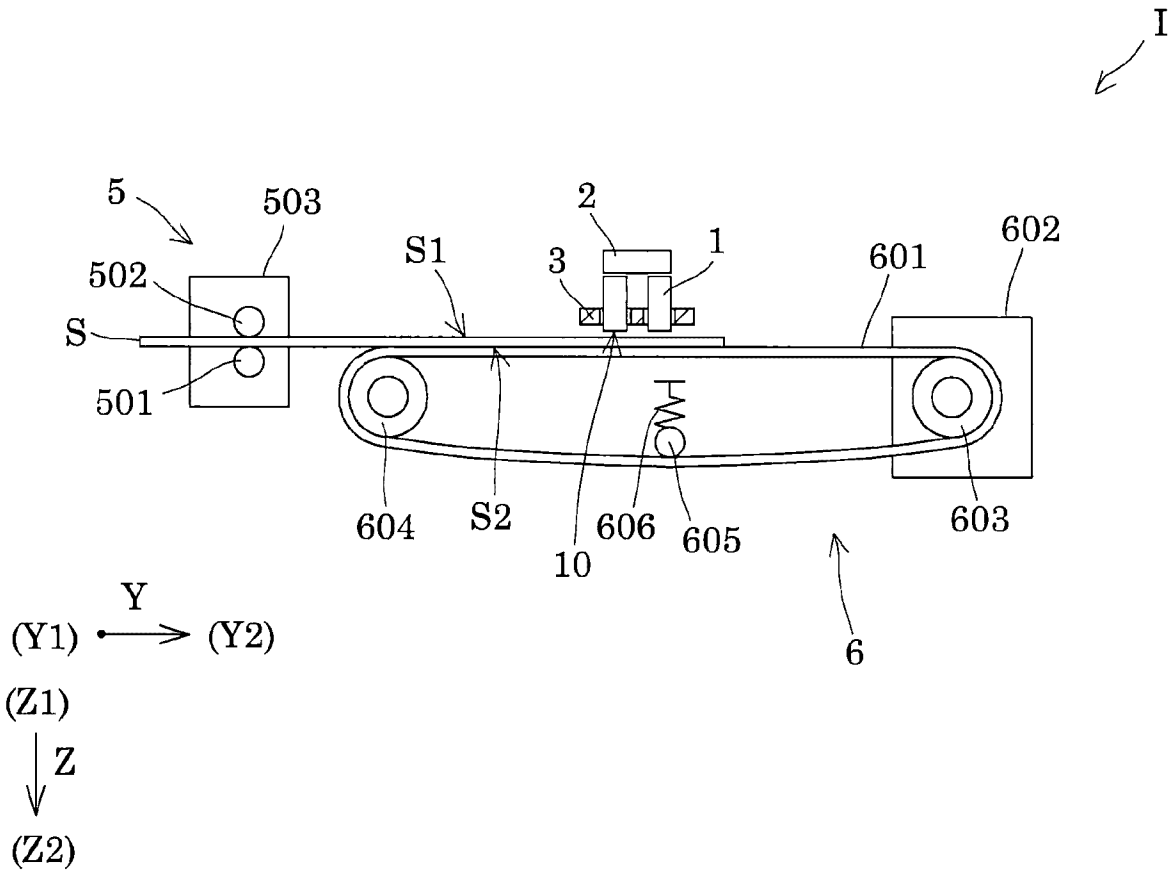
FIG. 2 is a side surface diagram illustrating the schematic configuration of the ink jet recording apparatus.

FIG. 1 is a top surface diagram illustrating the schematic configuration of an ink jet recording apparatus according to the present embodiment, and FIG. 2 is a side surface diagram illustrating the schematic configuration of the ink jet recording apparatus.

An ink jet recording apparatus I is a so-called line system ink jet recording apparatus which performs printing by simply transporting a recording sheet S which is an ejection-target medium.

The ink jet recording apparatus I includes a plurality of head units 1, a supply member 2 which supplies an ink to the plurality of head units 1, a supporting body 3 which supports the plurality of head units 1, and a liquid supply unit 4 such as an ink tank which stores the ink. The ink jet recording apparatus I may include a transport unit, a pressure adjustment mechanism 18, and an open-close valve 78.

The plurality of head units 1 are held by the supporting body 3. Specifically, a plurality, three in the present embodiment, of the head units 1 are provided to line up in a direction intersecting the transport direction of the recording sheet S. Hereinafter, the direction in which the head units 1 are lined up will be referred to as a first direction X. In the supporting body 3, a plurality of rows in which the head units 1 are lined up in the first direction X are provided in the transport direction of the recording sheet S, and in the present embodiment, two rows are provided. The direction in which the plurality of rows of the head units 1 are provided to line up is also referred to as a second direction Y, an upstream side in the transport direction of the recording sheet S in the second direction Y is referred to as a Y1 side, and the downstream side is referred to as a Y2 side. A direction intersecting both the first direction X and the second direction Y is referred to as a third direction Z in the present embodiment, a head unit 1 side is referred to as a Z1 side, and a recording sheet S side is referred to as a Z2 side. In the present embodiment, the relationship between the directions (X, Y, and Z) is orthogonal; however, the dispositional relationship of the components is not necessarily limited to being orthogonal. The supporting body 3 which holds the head unit 1 is fixed to an apparatus main body 7. The supply member 2 is fixed to the plurality of head units 1 which are held by the supporting body 3. The ink which is supplied from the supply member 2 is supplied to the head units 1.

The liquid supply unit 4 is provided with a tank or the like in which the ink is stored as a liquid, and in the present embodiment, the liquid supply unit 4 is fixed to the apparatus main body 7. The ink from the liquid supply unit 4 which is fixed to the apparatus main body 7 is supplied to the supply member 2 via a supply pipe 8 such as a tube, and the ink which is supplied to the supply member 2 is supplied to the head unit 1. The liquid supply unit 4 such as an ink cartridge may be mounted on the Z1 side in the third direction Z of the supply member 2, for example, in an aspect in which the supply member 2 of the head unit 1 includes the liquid supply unit 4.

Although described in detail later, the pressure adjustment mechanism 18 is a device which includes a pump or the like which is capable of selectively pressurizing or decompressing a flow path which is provided in the head unit 1. The pressure adjustment mechanism 18 is connected to the head units 1 via a connecting pipe 18*a*. The open-close valve 78 is a valve which is connected to a collective return flow path 88 which is described later. The open-close valve 78 is connected to the head units 1 via a connecting pipe 78*a*.

A first transport unit 5 which serves as an example of the transport unit is provided on the Y1 side in the second direction Y. The first transport unit 5 includes a first transport roller 501, and a first following roller 502 which follows the first transport roller 501. The first transport roller 501 is provided on the side of a back surface S2 of the opposite side to a landing surface S1 of the recording sheet S on which the ink lands, and is driven by the driving force of a first drive motor 503. The first following roller 502 is provided on the landing surface S1 side of the recording sheet S, and sandwiches the recording sheet S with the first transport roller 501. The first following roller 502 presses the recording sheet S toward the first transport roller 501 side using a biasing member such as a spring (not illustrated).

A second transport unit 6 which serves as an example of the transport unit is provided on the Y2 side which is the downstream side of the first transport unit 5, and includes a transport belt 601, a second drive motor 602, a second transport roller 603, a second following roller 604, and a tension roller 605.

The second transport roller 603 is driven by the driving force of the second drive motor 602. The transport belt 601 is formed of an endless belt, and is wrapped around the outer circumference of the second transport roller 603 and the second following roller 604. The transport belt 601 is provided on the back surface S2 of the recording sheet S. The tension roller 605 is provided between the second transport roller 603 and the second following roller 604, abuts the inner circumferential surface of the transport belt 601, and applies tension to the transport belt 601 through the biasing force of a biasing member 606 such as a spring. Accordingly, the transport belt 601 has a flat surface that mutually faces the head unit 1 between the second transport roller 603 and the second following roller 604.

Although not specifically illustrated, the apparatus main body 7 is provided with a control unit. The control unit controls the operations of the ink jet recording apparatus I and the head unit 1.

In the ink jet recording apparatus I, while transporting the recording sheet S from the Y1 side to the Y2 side in the second direction Y with respect to the head unit 1 using the first transport unit 5 and the second transport unit 6, ink is ejected from the head unit 1, and the ejected ink is caused to land on the landing surface S1 of the recording sheet S to perform the printing. The transport unit is not limited to the first transport unit 5 and the second transport unit 6 which are described above, and a transport unit using a so-called drum, a transport unit including a platen, or the like may be used.

Figure 3:
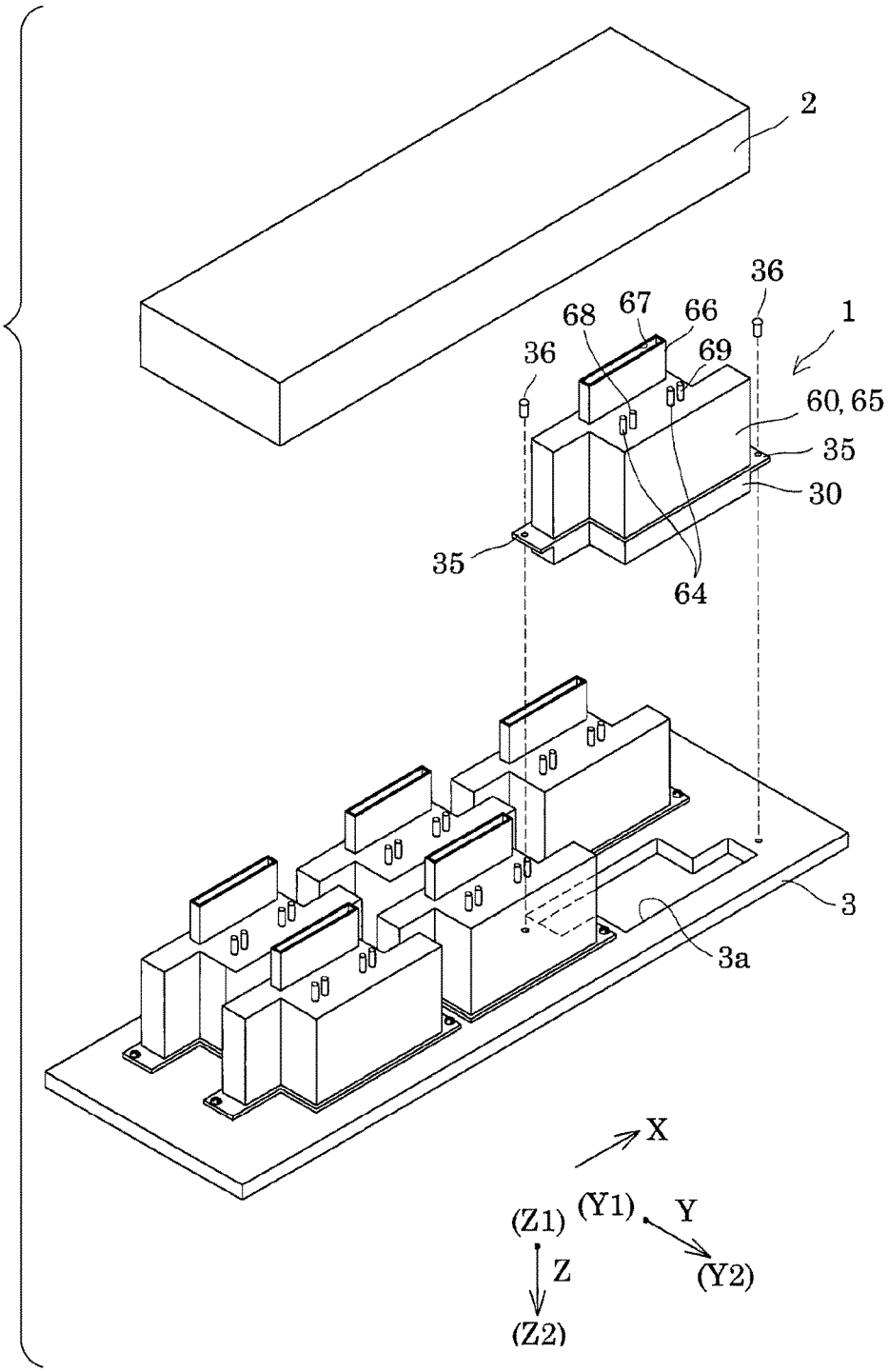
FIG. 3 is an exploded perspective diagram of a head unit and a supporting body.
Figure 4:
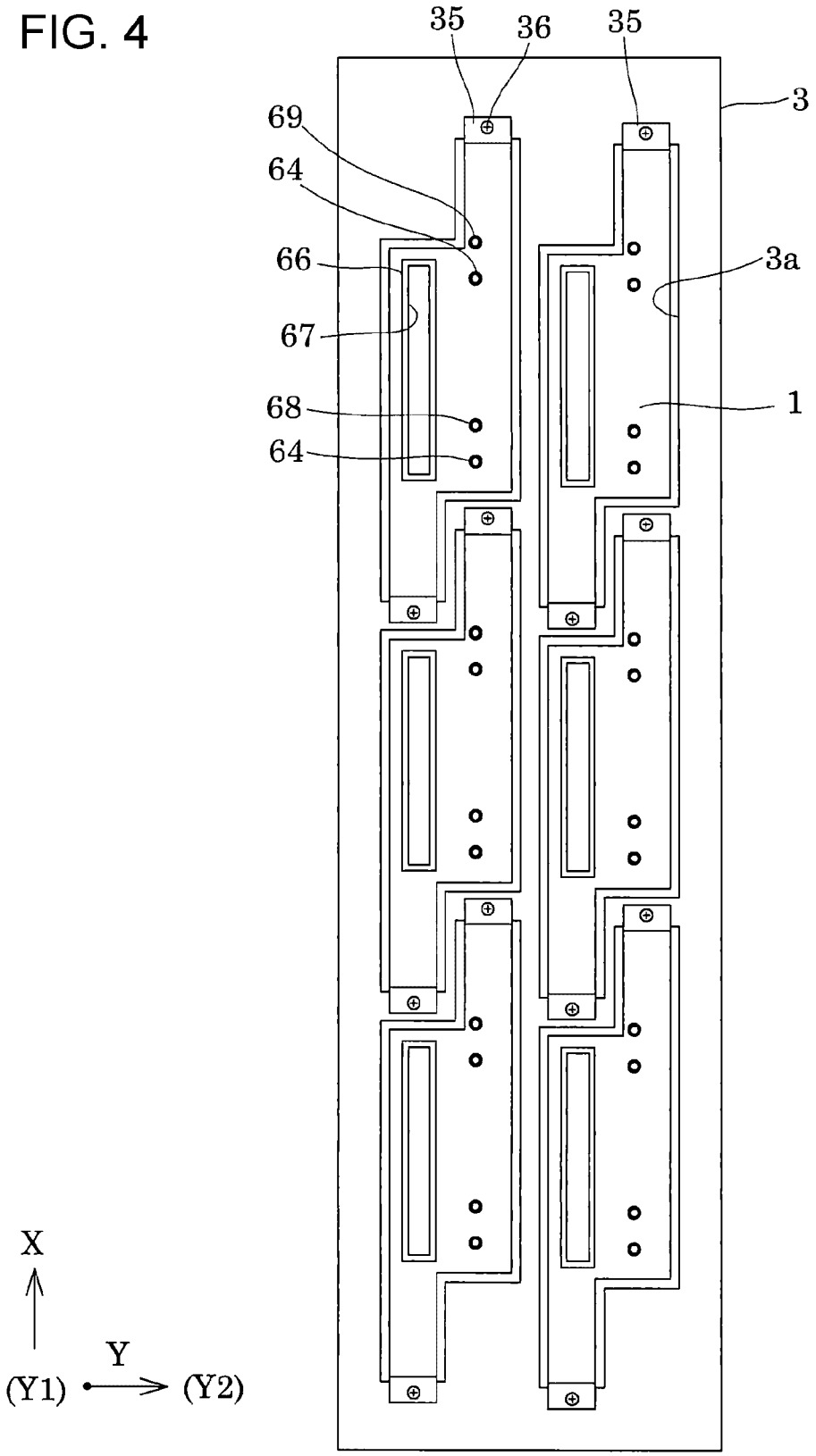
FIG. 4 is a top surface diagram of the head unit and the supporting body.
Figure 5:
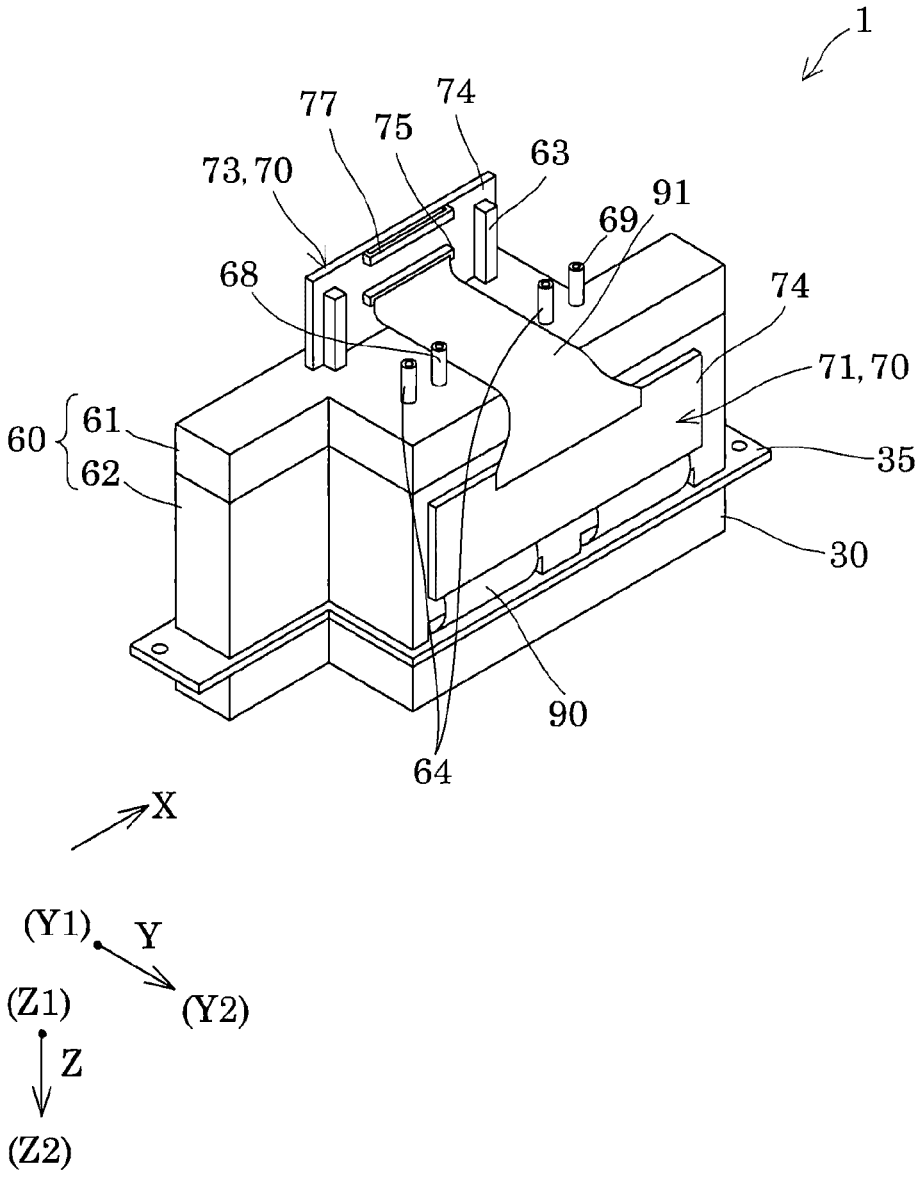
FIG. 5 is a perspective diagram of the head unit.
Figure 6:
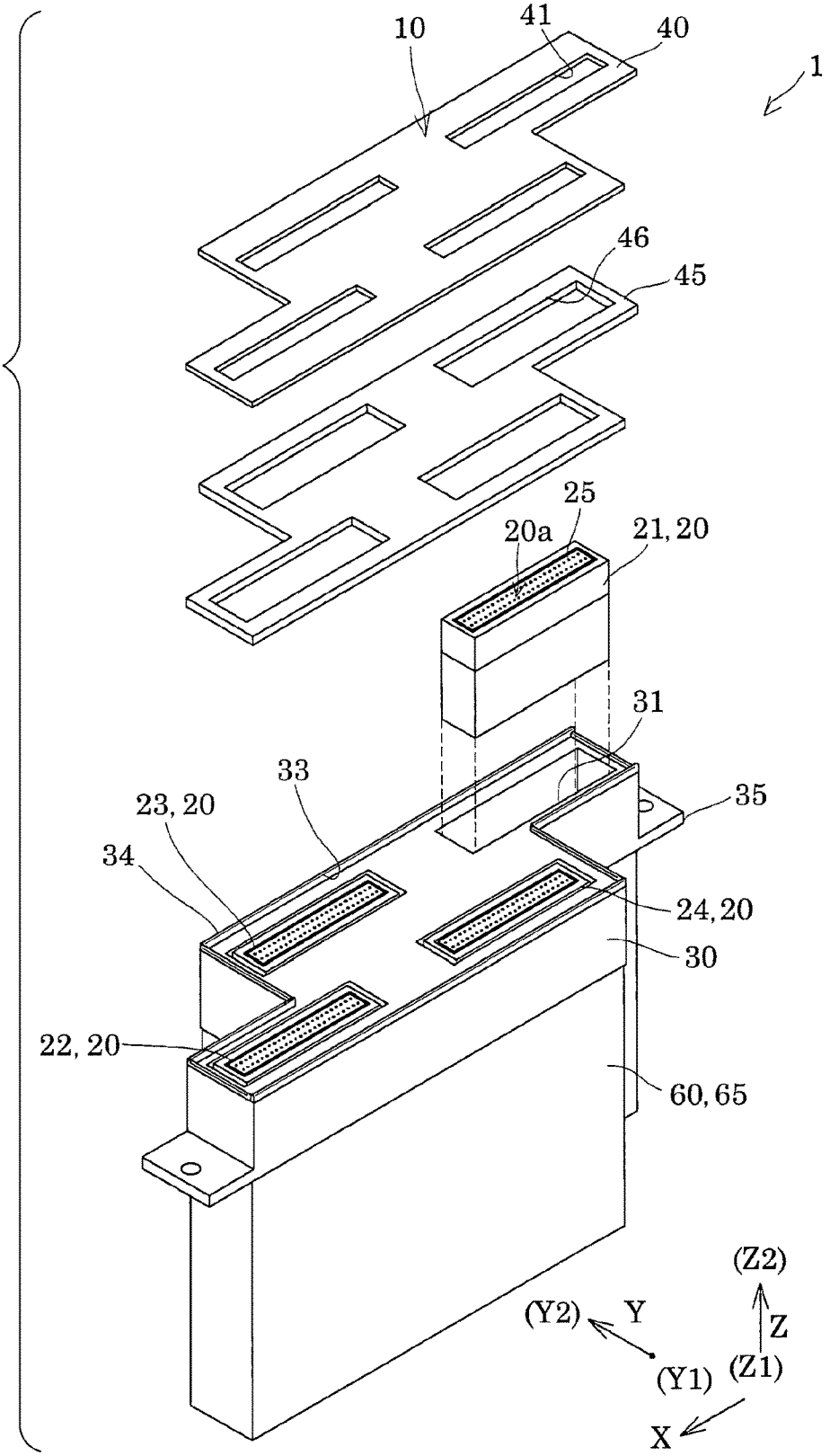
FIG. 6 is an exploded perspective diagram of the head unit.
Figure 7:
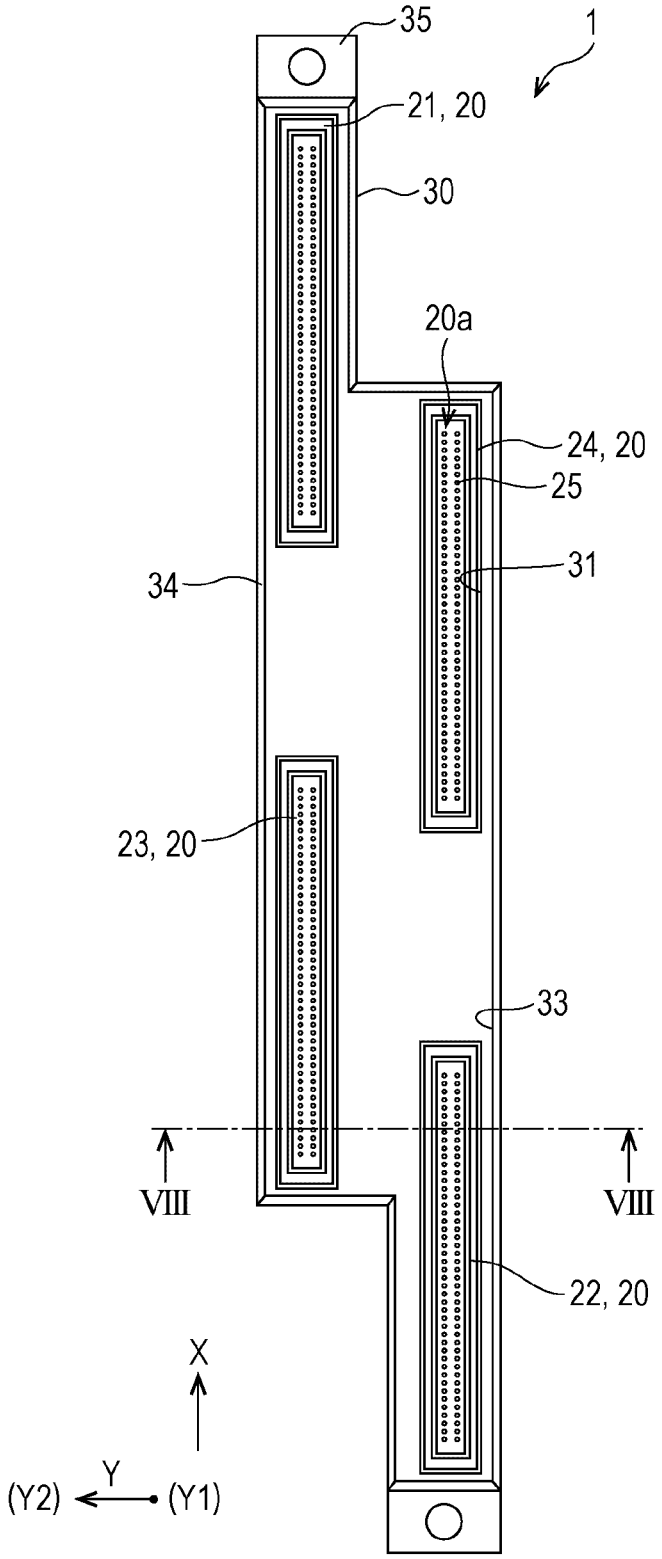
FIG. 7 is a plan view of the main components of the head unit.
Figure 8:
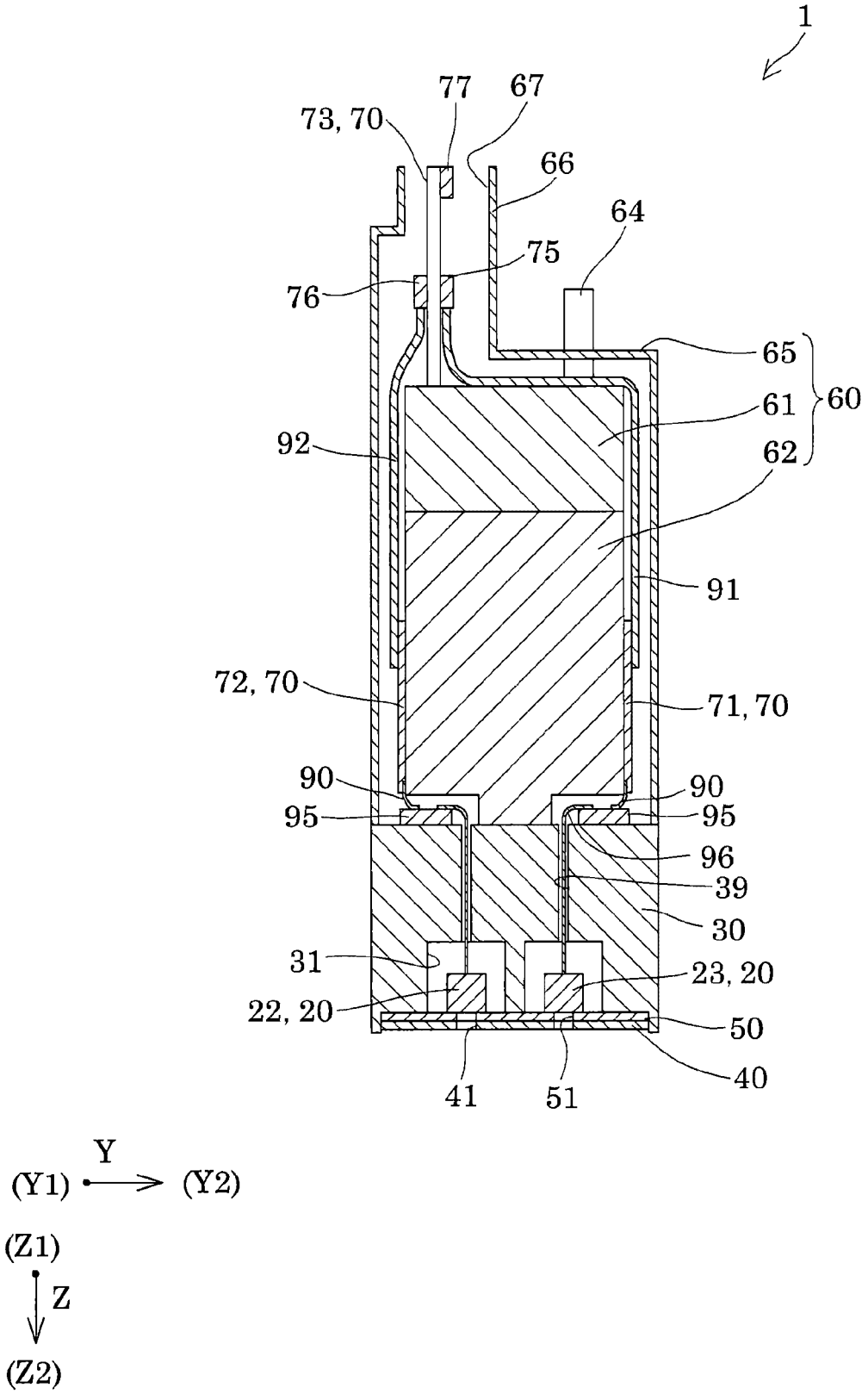
FIG. 8 is a sectional diagram taken along the line VIII-VIII of FIG. 7.
Figure 9:
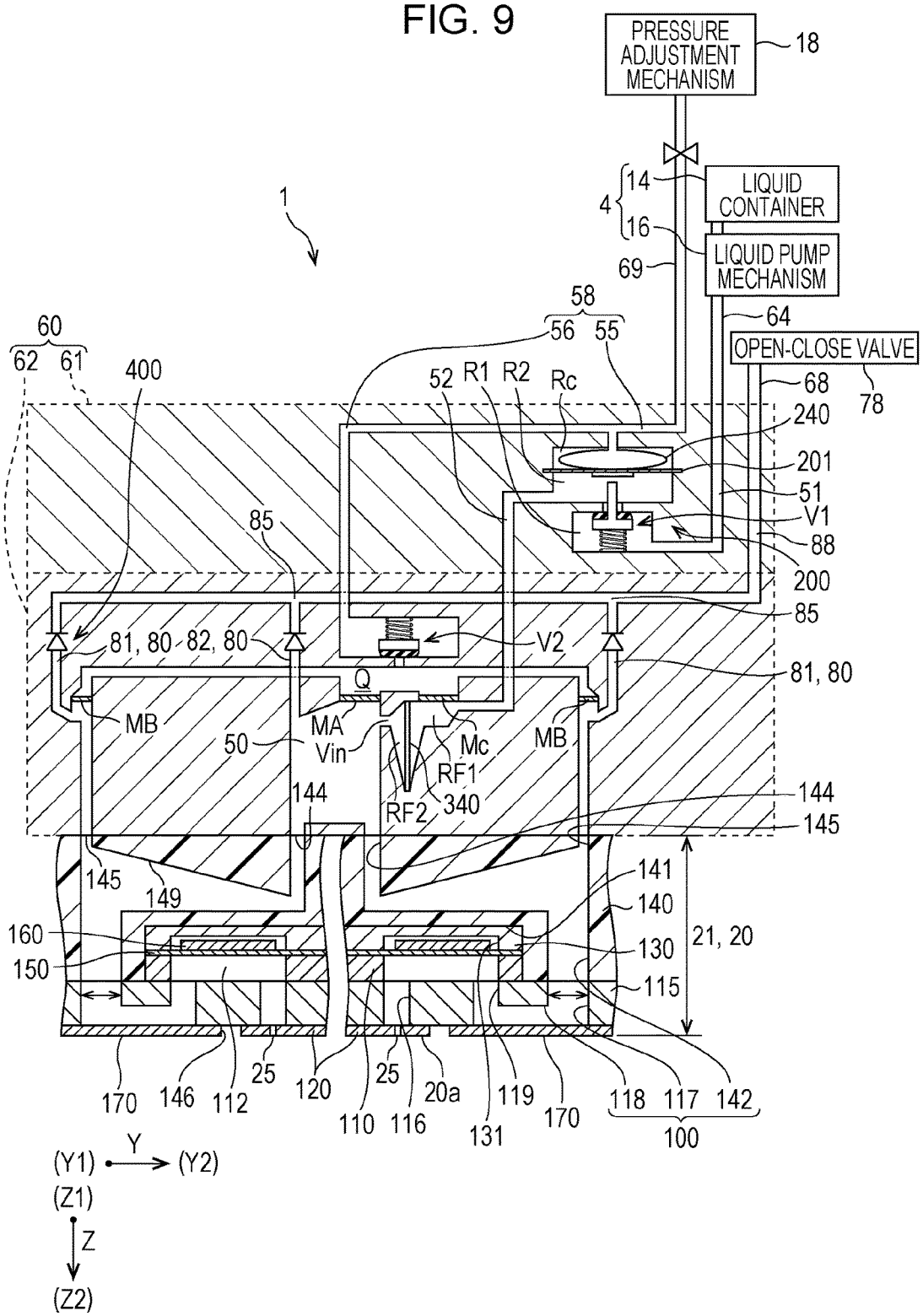
FIG. 9 is a sectional diagram of a flow path member and a drive unit.

Detailed description will be given of the head unit 1 with reference to FIGS. 3 to 8. FIG. 3 is an exploded perspective diagram of a head unit and a supporting body, FIG. 4 is a top surface diagram of the head unit and the supporting body, FIG. 5 is a perspective diagram of the head unit, FIG. 6 is an exploded perspective diagram of the head unit, FIG. 7 is a plan view of the main components of the head unit, FIG. 8 is a sectional diagram taken along the line VIII-VIII of FIG. 7, and FIG. 9 is a sectional diagram of the flow path member and the drive unit. For the head unit 1 of FIG. 5, a cover member 65 is omitted, and the inner portion of the cover member 65 is illustrated. Although a first drive unit 21 is exemplified in FIG. 9, the same applies to the other drive units, a second drive unit 22, a third drive unit 23, and a fourth drive unit 24.

As illustrated in FIGS. 3 and 4, the supporting body 3 which supports the plurality of head units 1 is formed of a plate member which is formed of a conductive material such as a metal. A support hole 3*a* for holding each of the head units 1 is provided in the supporting body 3. In the present embodiment, the support holes 3*a* are provided independently for each of the head units 1. Naturally, the support holes 3*a* may be provided continuously across the plurality of head units 1.

The head unit 1 is held inside the support hole 3*a* of the supporting body 3 in a state in which an ejecting surface 10 is caused to protrude from the surface of the Z2 side of the supporting body 3. The ejecting surface 10 of the present embodiment is a surface which faces the recording sheet S of the head unit 1, and is a surface of the Z2 side of a fixing plate 40, which will be described later.

The head unit 1 is provided with a holder 30 which holds the drive units which are described later. Flange portions 35 are provided on both sides of the holder 30 in the first direction X to be integral with the holder 30. The flange portions 35 are fixed to the supporting body 3 by fixing screws 36. A plurality of the head units 1 which are held by the supporting body 3 in this manner are provided in the first direction X. In the present embodiment three rows of the head units 1 which are provided to line up are provided in two rows in the second direction Y.

As illustrated in FIGS. 5, 6, and 9, the head unit 1 is provided with the first drive unit 21, the second drive unit 22, the third drive unit 23, and the fourth drive unit 24 which eject an ink from nozzle openings 25, a manifold 100 which is an example of a common liquid chamber, a bubble return flow path 80, a confluence point 85, a collective return flow path 88, and a one-way valve 400. The head unit 1 is provided with the ejecting surface 10 in which the plurality of nozzle openings 25 which eject the ink are formed, a first circuit substrate 71, a second circuit substrate 72, and a third circuit substrate 73 which are for ejecting the ink from the nozzle openings 25. The head unit 1 includes the holder 30, the fixing plate 40, a reinforcing plate 45, and a flow path member 60.

The first drive unit 21, the second drive unit 22, the third drive unit 23, and the fourth drive unit 24 are collectively referred to as a drive unit 20. The first circuit substrate 71, the second circuit substrate 72, and the third circuit substrate 73 are collectively referred to as a circuit substrate 70.

As illustrated in FIG. 7, the nozzle openings 25 which eject the ink are provided to line up along the first direction X in the drive unit 20. In the drive unit 20, a plurality of rows in which the nozzle openings 25 are lined up in the first direction X are provided in the second direction Y, and in the present embodiment, two rows are provided.

The drive unit 20 is provided with a flow path which communicates with the nozzle openings 25, and a pressure generating unit which generates a pressure change in the ink in the flow path. The surface in which the nozzle openings 25 of the drive unit 20 are opened is a nozzle surface 20*a*. In other words, the nozzle surface 20*a* in which the nozzle openings 25 are formed is included in the ejecting surface 10 of the head unit 1. As the pressure generating unit, for example, it is possible to use a pressure generating unit which causes the volume of the flow path to change through the deformation of a piezoelectric actuator including a piezoelectric material which exhibits an electromechanical conversion function, generates a pressure change in the ink inside the flow path, and discharges ink droplets from the nozzle openings 25. It is also possible to use a pressure generating unit in which a heat generating element is disposed inside the flow path, and ink droplets are discharged from the nozzle openings 25 due to bubbles which are generated by the heat generation of the heat generating element. It is also possible to use a so-called electrostatic actuator or the like which generates an electrostatic force between a diaphragm and an electrode, causes the diaphragm to deform using the electrostatic force, and discharges ink droplets from the nozzle openings 25.

As illustrated in FIGS. 5 to 8, the holder 30 is formed of a conductive material such as a metal, for example. The holder 30 has a greater strength than the fixing plate 40. Housing portions 31 which house the plurality of drive units 20 are provided on the surface of the Z2 side of the holder 30 in the third direction Z. The housing portions 31 have a concave shape which is opened to one side in the third direction Z, and house the plurality of drive units 20 which are fixed by the fixing plate 40. The openings of the housing portions 31 are sealed by the fixing plate 40. In other words, the drive units 20 are housed in the inner portion of the space which is formed by the housing portions 31 and the fixing plate 40. The housing portions 31 may be provided for each of the drive units 20, and may be provided continuously across the plurality of drive units 20. In the present embodiment, the housing portions 31 are provided independently for each of the drive units 20.

The drive units 20 are disposed in a staggered pattern along the first direction X in the holder 30. Disposing the drive units 20 staggered along the first direction X means disposing the drive units 20 which are provided to line up in the first direction X alternately shifted in the second direction Y. In other words, two rows of the drive units 20 which are provided to line up in the first direction X are provided to line up in the second direction Y, and the two rows of the drive units 20 are disposed shifted by a half pitch in the first direction X. By disposing the drive units 20 staggered along the first direction X in this manner, it is possible to cause the nozzle openings 25 of the two drive units 20 to partially overlap in the first direction X to form rows of the nozzle openings 25 which are continuous across the first direction X.

As illustrated in FIGS. 6 to 8, a recessed portion 33 which has a recessed shape to which the reinforcing plate 45 and the fixing plate 40 are fixed is provided on the surface of the Z2 side of the holder 30 at which the housing portion 31 is provided. In other words, the outer circumferential edge portion of the surface of the Z2 side of the holder 30 is an edge portion 34 which is provided to protrude to the Z2 side, and the recessed portion 33 is formed by the edge portion 34 which protrudes to the Z2 side. The reinforcing plate 45 and the fixing plate 40 are sequentially stacked on the bottom surface of the recessed portion 33. In the present embodiment, the bottom surface of the recessed portion 33 of the holder 30 is adhered to the reinforcing plate 45 using an adhesive, and the reinforcing plate 45 is adhered to the fixing plate 40 using an adhesive.

The fixing plate 40 is formed of a plate member which is formed of a conductive material such as a metal. The fixing plate 40 is provided with exposure opening portions 41 which expose the nozzle surfaces 20*a* of the drive units 20. In the present embodiment, the exposure opening portions 41 are provided independently for each of the drive units 20. The fixing plate 40 is fixed to the nozzle surface 20*a* side of the drive units 20 at the circumferential edge portion of the exposure opening portions 41.

The fixing plate 40 is fixed to the inside of the recessed portion 33 of the holder 30 via the reinforcing plate 45 so as to block the opening of the housing portion 31 of the holder 30.

It is preferable to use a material with a greater strength than the fixing plate 40 for the reinforcing plate 45. In the present embodiment, a plate member of the same material as the fixing plate 40 and which is thicker than the fixing plate 40 in the third direction Z is used for the reinforcing plate 45.

Opening portions 46 which have inner diameters larger than the outer circumferences of the drive units 20 are provided to penetrate the reinforcing plate 45 in the third direction Z in correspondence with the drive units 20 which are bonded to the fixing plate 40. The drive units 20 which are inserted into the opening portions 46 of the reinforcing plate 45 are bonded to the surface on the Z1 side of the fixing plate 40.

The fixing plate 40 and the holder 30 are pressed against each other at a predetermined pressure in a state in which the surface of the Z2 side of the fixing plate 40 is supported by a supporting tool (not illustrated), and are bonded together. Incidentally, in the present embodiment, in the fixing plate 40, a bonded body in which the drive units 20, the reinforcing plate 45, and the fixing plate 40 are bonded in advance is fixed to the holder 30.

The flow path member 60 is fixed to the Z1 side of the holder 30. In the present embodiment, the flow path member 60 is provided with a first flow path member 61, a second flow path member 62, and the cover member 65. The first flow path member 61 is provided on the Z1 side of the second flow path member 62, and the second flow path member 62 is supported on the Z1 side of the holder 30. The cover member 65 has a concave shape which houses the first flow path member 61 and the second flow path member 62, and the circuit substrate 70 therein, and is fixed to the holder 30 in a state of housing the first flow path member 61 and the second flow path member 62, and the circuit substrate 70 therein.

Flow paths for supplying the ink to the drive units 20 are provided in the inner portions (not illustrated) of the first flow path member 61 and the second flow path member 62. Inlets 64 which communicate with the flow paths are provided on the Z1 side of the first flow path member 61. The inlets 64 are connected to the supply pipe 8 and the supply member 2, and the ink is supplied from the liquid supply unit 4. In the present embodiment, two of the inlets 64 are provided along the first direction X. A discharge port 68 and a pressure adjustment port 69 are provided on the Z1 side of the first flow path member 61. The connecting pipe 78*a* (refer to FIG. 1) is connected to the discharge port 68, and the discharge port 68 is connected to the open-close valve 78 (refer to FIG. 1) via the connecting pipe 78*a*. The connecting pipe 18*a* (refer to FIG. 1) is connected to the pressure adjustment port 69, and the pressure adjustment port 69 is connected to the pressure adjustment mechanism 18 via the connecting pipe 18*a*. Description will be given later of the internal configuration of the head unit 1 which is connected to the inlet 64, the discharge port 68, and the pressure adjustment port 69.

As illustrated in FIGS. 5 and 8, the first circuit substrate 71 is provided with a substrate 74, a terminal portion (not illustrated) which is connected to a relay wiring 90, and a terminal portion (not illustrated) which is connected to a first connection wiring 91. Similarly, the second circuit substrate 72 is provided with the substrate 74, the terminal portion (not illustrated) which is connected to the relay wiring 90, and the terminal portion (not illustrated) which is connected to a second connection wiring 92. The third circuit substrate 73 is provided with the substrate 74, a first connector 75 to which the first connection wiring 91 is connected, a second connector 76 to which the second connection wiring 92 is connected, and a third connector 77. The circuit substrates 70 are provided with electronic components, wirings, and the like which are not specifically illustrated in addition to the terminal portions and connectors which are described above.

The third circuit substrate 73 is provided to stand on the Z1 side of the first flow path member 61 such that both surfaces of the substrate 74 face the Y1 and Y2 sides in the second direction Y, respectively. In the present embodiment, the third circuit substrate 73 is fixed to a support portion 63 which is provided to stand on the Z1 side of the second flow path member 62.

The first connection wiring 91 is connected to the first connector 75 which is provided on the third circuit substrate 73. The first connection wiring 91 is a wiring which connects the first connector 75 to the terminal portion (not illustrated) of the first circuit substrate 71. The second connection wiring 92 is connected to the second connector 76 which is provided on the third circuit substrate 73. The second connection wiring 92 is a wiring which connects the second connector 76 to the terminal portion (not illustrated) of the second circuit substrate 72.

The cover member 65 is provided with a substrate housing portion 66 which houses the third circuit substrate 73 and the third connector 77 is exposed from a connection opening portion 67 which is provided on the Z1 side of the substrate housing portion 66. Wiring (not illustrated) for connecting to an external control unit is connected to the third connector 77. A print signal and power from the external control unit are supplied to the third circuit substrate 73 via the wiring.

The first circuit substrate 71 is provided on a side surface of the second flow path member 62 facing the Y2 side. The first circuit substrate 71 is connected to the third circuit substrate 73 via the first connection wiring 91, and is connected to the first drive unit 21 and the third drive unit 23 (refer to FIGS. 6 and 7) via the relay wiring 90, a relay substrate 95, and a wiring substrate 96.

The second circuit substrate 72 is provided on a side surface of the second flow path member 62 facing the Y1 side. The second circuit substrate 72 is connected to the third circuit substrate 73 via the second connection wiring 92, and is connected to the second drive unit 22 and the fourth drive unit 24 (refer to FIGS. 6 and 7) via the relay wiring 90, the relay substrate 95, and the wiring substrate 96.

The relay substrate 95 is provided on the surface of the Z1 side of the holder 30. The holder 30 is provided with a communication hole 39 which penetrates in the Z direction and causes the housing portion 31 to communicate with the Z1 side. The wiring substrate 96 which is connected to the drive unit 20 is inserted through the communication hole 39. One end of the wiring substrate 96 is connected to the drive unit 20, and the other end is connected to the relay substrate 95. For the relay wiring 90 and the wiring substrate 96, it is possible to use a flexible sheet, for example, a COF substrate or the like. In addition, an FFC, an FPC, or the like may be used for the relay wiring 90 and the wiring substrate 96.

The wiring substrate 96 is a substrate on which a wiring for supplying a signal and power for driving the drive unit 20 is installed. The wiring substrate 96 is connected to the first circuit substrate 71 or the second circuit substrate 72 via the relay substrate 95 and the relay wiring 90.

By configuring the circuit substrate 70 in this manner, a print signal and power are supplied from the external control unit to the third circuit substrate 73 from the third connector 77. The print signal and the like are supplied to the first drive unit 21 and the third drive unit 23 via the first connection wiring 91, the first circuit substrate 71, the relay substrate 95, and the wiring substrate 96. The print signal and the like are supplied to the second drive unit 22 and the fourth drive unit 24 via the second connection wiring 92, the second circuit substrate 72, the relay substrate 95, and the wiring substrate 96.

In the head unit 1 which is configured as described above, the ink is supplied from the supply member 2 via the flow path member 60, and the pressure generating unit inside the drive unit 20 is driven based on the print signal which is supplied via the circuit substrate 70 thereby ejecting ink droplets from the nozzle openings 25.

Detailed description will be given of the flow paths and the drive units of the head unit 1 using FIG. 9. The first drive unit 21 is formed of a plurality of members such as a flow path forming substrate 110, a communicating plate 115, a nozzle plate 120, a protective substrate 130, a compliance substrate 170, and a manifold forming member 140.

Pressure chambers 112 which are partitioned by a plurality of partition walls are provided to line up in the flow path forming substrate 110. The head unit 1 is mounted on the ink jet recording apparatus I such that the direction in which the pressure chambers 112 of each of the drive units 20 are lined up is the first direction X (refer to FIG. 7). In the flow path forming substrate 110, rows in which the pressure chambers 112 are provided to line up in the first direction X are provided to line up in the second direction Y orthogonal to the first direction X in a plurality of rows, in the present embodiment, in two rows.

It is possible to use a metal such as stainless steel or Ni, a ceramic material, a typical example of which is $ZrO_2$ or $Al_2O_3$, a glass ceramic material, or an oxide such as MgO or $LaAlO_3$ for the flow path forming substrate 110. In the present embodiment, the flow path forming substrate 110 is formed of a silicon single crystal substrate. In the flow path forming substrate 110, by performing anisotropic etching from one surface side, pressure chambers 112, which are partitioned by a plurality of partition walls, are provided to line up along a direction in which the plurality of nozzle openings 25 that eject the ink are provided to line up.

The communicating plate 115 and the nozzle plate 120 are sequentially stacked on the Z2 side in the third direction Z of the flow path forming substrate 110. In other words, there is provided the communicating plate 115 which is provided on the surface of the Z2 side of the flow path forming substrate 110 in the third direction Z, and the nozzle plate 120 which includes the nozzle openings 25 which are provided on the opposite surface side from the flow path forming substrate 110 of the communicating plate 115, that is, on the surface of the Z2 side of the communicating plate 115.

Nozzle communicating paths 116 which communicate the pressure chambers 112 with the nozzle openings 25 are provided in the communicating plate 115. The communicating plate 115 has a larger area than that of the flow path forming substrate 110, and the nozzle plate 120 has a smaller area than that of the flow path forming substrate 110. Since the nozzle openings 25 of the nozzle plate 120 and the pressure chambers 112 can be separated by providing the communicating plate 115 in this manner, the ink within the pressure chambers 112 is not easily influenced by an increase in viscosity caused by the evaporation of water content in the ink, which occurs in the ink in the proximity of the nozzle openings 25. Since it is sufficient for the nozzle plate 120 to only cover the openings of the nozzle communicating paths 116 which communicate the pressure chambers 112 with the nozzle openings 25, it may be possible to comparatively reduce the area of the nozzle plate 120, and it is possible to reduce the costs.

The communicating plate 115 is provided with a first manifold portion 117 and a second manifold portion 118 (a constricting flow path and an orifice flow path), which configure a portion of the manifold 100.

The first manifold portion 117 is provided to penetrate the communicating plate 115 in the thickness direction Z. The thickness direction referred to here is the third direction Z in which the communicating plate 115 and the flow path forming substrate 110 are stacked. The second manifold portion 118 does not penetrate the communicating plate 115 in the thickness direction, and is provided to be open to the nozzle plate 120 side of the communicating plate 115.

The communicating plate 115 is provided with a supply communicating path 119 which communicates with one end portion of the pressure chamber 112 in the second direction Y independently for each of the pressure chambers 112. The supply communicating path 119 communicates the second manifold portion 118 with the pressure chamber 112.

It is possible to use a metal such as stainless steel or nickel (Ni), or a ceramic material such as zirconium (Zr) for the communicating plate 115. It is preferable that the communicating plate 115 is formed from a material with an equal coefficient of linear expansion to that of the flow path forming substrate 110. In other words, in a case in which a material with a coefficient of linear expansion sufficiently different from that of the flow path forming substrate 110 is used for the communicating plate 115, warping occurs in the flow path forming substrate 110 and the communicating plate 115 due to the flow path forming substrate 110 and the communicating plate 115 being subjected to heating or cooling. In the present embodiment, by using the same material as that of the flow path forming substrate 110 for the communicating plate 115, that is, by using a silicon single crystal substrate for the communicating plate 115, it is possible to suppress the occurrence of warping caused by heat, and to suppress cracking, peeling, and the like caused by heat.

The nozzle openings 25 which communicate with the pressure chambers 112 via the nozzle communicating paths 116 are formed in the nozzle plate 120. The nozzle openings 25 are provided to line up in the first direction X, and two rows of the nozzle openings 25 which are provided to line up in the first direction X are formed in the second direction Y. Of both the surfaces of the nozzle plate 120, the surface which ejects ink droplets, that is, the surface of the opposite side from the pressure chamber 112 is referred to as the nozzle surface 20*a*.

For example, it is possible to use a metal such as stainless steel (SUS), organic matter such as a polyimide resin, a silicon single crystal substrate or the like for the nozzle plate 120. By using the silicon single crystal substrate as the nozzle plate 120, the coefficients of linear expansion of the nozzle plate 120 and the communicating plate 115 are the same, and it is possible to suppress the occurrence of warping caused by heating or cooling, and to suppress cracking, peeling, and the like caused by heat.

Meanwhile, a diaphragm 150 is formed on the opposite surface side of the flow path forming substrate 110 from the communicating plate 115. In the present embodiment, an elastic film and an insulating film are provided as the diaphragm 150. The elastic film is formed of silicon oxide which is provided on the flow path forming substrate 110 side, and the insulating film is formed from zirconium oxide which is provided on the elastic film. The liquid flow path of the pressure chamber 112 and the like is formed by subjecting the flow path forming substrate 110 to anisotropic etching from one surface side (the side of the surface to which the nozzle plate 120 is bonded), and the other surface of the liquid flow path of the pressure chamber 112 and the like is partitioned by the elastic film.

A piezoelectric actuator 160 which is the pressure generating unit of the present embodiment is provided on the diaphragm 150 of the flow path forming substrate 110. Although not specifically illustrated, the piezoelectric actuator 160 is formed by laminating a first electrode, a piezoelectric layer, and a second electrode in the third direction Z. Generally, a configuration is adopted in which one of the electrodes in the piezoelectric actuator 160 is a common electrode, and the other electrode is patterned for each of the pressure chambers 112. In the present embodiment, the first electrode is provided continuously over the plurality of piezoelectric actuators 160 to form the common electrode, and the second electrode is provided independently for each of the piezoelectric actuators 160, thereby forming individual electrodes. Naturally, the configuration may be reversed without issue for the convenience of the drive circuit and the wiring. In the example described above, the diaphragm 150 is formed of an elastic film and an insulating film; however, naturally is not limited thereto. For example, either one of an elastic film and an insulating film may be provided as the diaphragm 150, or only the first electrode may function as the diaphragm without providing the elastic film and the insulating film as the diaphragm 150. The piezoelectric actuator 160 itself may also substantially act as the diaphragm.

The piezoelectric layer is formed of an oxide piezoelectric material having a polarized structure, and, for example, may be formed of a perovskite oxide represented by the general formula $ABO_3$, and may be formed of a lead-based piezoelectric material containing lead or a lead-free piezoelectric material not containing lead.

Although not specifically illustrated, a lead electrode is connected to the each of the second electrodes which are the individual electrodes of the piezoelectric actuator 160. The wiring substrate 96 (refer to FIG. 8) for driving the piezoelectric actuator 160 is connected to one end of the lead electrode.

The protective substrate 130 which is approximately the same size as the flow path forming substrate 110 is bonded to the surface of the piezoelectric actuator 160 side of the flow path forming substrate 110. The protective substrate 130 includes a holding portion 131 which is a space for protecting the piezoelectric actuator 160. The holding portion 131 has a recessed shape which is open to the flow path forming substrate 110 side without penetrating the protective substrate 130 in the third direction Z which is the thickness direction. The holding portion 131 is provided for each row which is formed of the plurality of piezoelectric actuators 160 which are provided to line up in the first direction X. In other words, the holding portion 131 is provided to house the rows of the piezoelectric actuators 160 which are provided to line up in the first direction X, and the holding portion 131 is provided to line up for each row of the piezoelectric actuators 160, that is, two holding portions are provided to line up in the second direction Y. The holding portion 131 may have a space which does not hinder the movement of the piezoelectric actuator 160, and the space may or may not be sealed.

It is preferable to use materials having substantially the same coefficient of thermal expansion as that of the flow path forming substrate 110, for example, glass, ceramic materials, and the like for the protective substrate 130, and in the present embodiment, the protective substrate 130 is formed using a silicon single crystal substrate of the same material as that of the flow path forming substrate 110. The bonding method of the flow path forming substrate 110 and the protective substrate 130 is not particularly limited. For example, in the present embodiment, the flow path forming substrate 110 and the protective substrate 130 are bonded to each other via an adhesive (not illustrated).

The manifold forming member 140 has substantially the same shape as the communicating plate 115 which is described above in plan view, and is bonded to the protective substrate 130 and the communicating plate 115 which is described above. Specifically, the manifold forming member 140 includes a recessed portion 141 on the protective substrate 130 side. The recessed portion 141 has a depth in which the flow path forming substrate 110 and the protective substrate 130 are housed. The recessed portion 141 has a wider opening area than that of the surface of the protective substrate 130 that is joined to the flow path forming substrate 110. The opening surface of the nozzle plate 120 side of the recessed portion 141 is sealed by the communicating plate 115 in a state in which the flow path forming substrate 110 and the like are housed in the recessed portion 141. Accordingly, in the outer circumferential portion of the flow path forming substrate 110, a third manifold portion 142 is formed by being partitioned by the manifold forming member 140.

The manifold 100, which is an example of a common liquid chamber, is formed of the first manifold portion 117, the second manifold portion 118, and the third manifold portion 142 by the communicating plate 115 and the manifold forming member 140. In the present embodiment, one manifold 100 is provided for each row of the pressure chambers 112.

An inlet 144 which communicates with the manifolds 100 is provided in the manifold forming member 140. The inlet 144 communicates with a common manifold 50 which is described later, and the ink is supplied to the inlet 144 from the common manifold 50. A discharge port 145 which communicates with the manifolds 100 is provided in the manifold forming member 140.

For example, it is possible to use a resin, a metal, or the like as the material of the manifold forming member 140. Incidentally, by forming the manifold forming member 140 from a resin material, it is possible to perform mass production thereof at low cost.

The compliance substrate 170 is provided on the surface of the communicating plate 115 to which the first manifold portion 117 and the second manifold portion 118 are open. The compliance substrate 170 has substantially the same size as the communicating plate 115 which is described above in plan view, and is provided with a first exposure opening portion 146 which exposes the nozzle plate 120. The compliance substrate 170 seals the openings of the nozzle surface 20*a* side of the first manifold portion 117 and the second manifold portion 118 in a state in which the nozzle plate 120 is exposed by the first exposure opening portion 146. In other words, the compliance substrate 170 forms a portion of the manifold 100 through partitioning.

The compliance substrate 170 includes a sealing film and a fixing substrate which are not illustrated. The sealing film is formed of a thin film which takes the form of a film with flexibility, and the fixing substrate is formed of a hard material such as a metal such as stainless steel (SUS). One surface of the manifold 100 is sealed by only a sealing film which has flexibility. The pressure fluctuations of the manifold 100 are absorbed by the compliance substrate 170.

In the first drive unit 21 of this configuration, when the ink is ejected, the ink is taken in via the inlet 144, and the inner portion of the flow path from the manifold 100 to the nozzle opening 25 is filled with the ink. Subsequently, a voltage is applied to each of the piezoelectric actuators 160 corresponding to the pressure chambers 112 according to a print signal which is transmitted from the circuit substrate 70 and the like (see FIG. 8 and the like), so that the diaphragm 150 is bent and deformed together with the piezoelectric actuator 160. Accordingly, the pressure within the pressure chamber 112 rises, and ink droplets are ejected from the predetermined nozzle opening 25.

Figure 10:
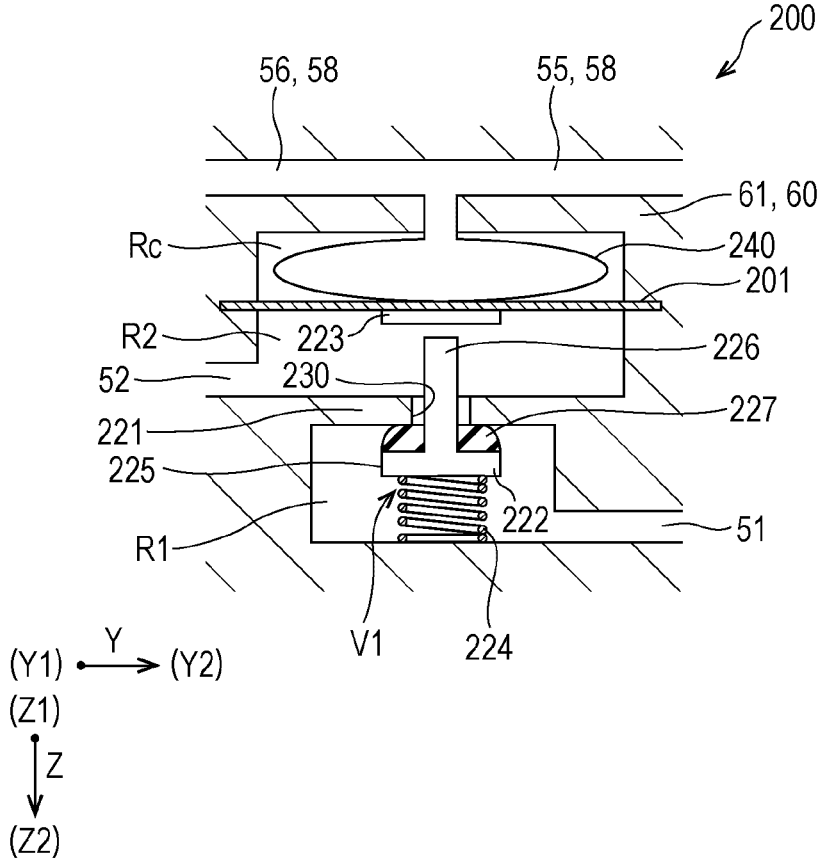
FIG. 10 is a sectional diagram in which a valve mechanism of FIG. 9 is enlarged.
Figure 11:
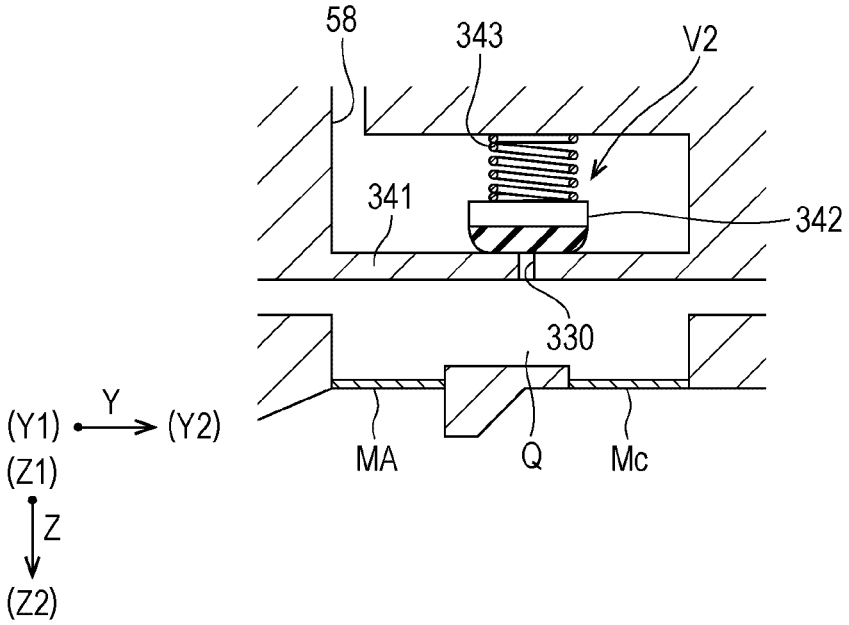
FIG. 11 is a sectional diagram in which a check valve of FIG. 9 is enlarged.

Description will be given of the flow path which supplies the ink to the drive units 20 of the configuration which is described above and the degassing path which discharges the bubbles in the ink, using FIGS. 9 to 11. FIG. 10 is a sectional diagram in which a valve mechanism 200 of FIG. 9 is enlarged, and FIG. 11 is a sectional diagram in which a check valve V2 of FIG. 9 is enlarged.

As illustrated in FIG. 9, the common manifold 50 which is a space which communicates with the two manifolds 100 is formed in the second flow path member 62. The common manifold 50 is an example of an upstream flow path which is closer to the upstream side than the manifold 100. The common manifold 50 communicates with the two inlets 144 which are provided in the first drive unit 21, and communicates with the manifolds 100 via the inlets 144.

A first supply flow path 51 and a second supply flow path 52, which are flow paths which are formed in the flow path member 60, are connected to the common manifold 50. The first supply flow path 51 is a flow path which communicates with the inlet 64 which is an introduction portion of the ink which is supplied from the outside of the head unit 1. The second supply flow path 52 is a flow path which is provided closer to the common manifold 50 side than the first supply flow path 51.

The valve mechanism 200 is provided between the first supply flow path 51 and the second supply flow path 52. The valve mechanism 200 is provided with a space R1, a space R2, and a control chamber Rc which are provided between the first supply flow path 51 and the second supply flow path 52. An open-close valve V1 is installed between the space R1 and the space R2, and a movable film 201 is provided between the space R2 and the control chamber Rc. The space R1 is connected to the liquid supply unit 4 via the first supply flow path 51. The liquid supply unit 4 of the present embodiment is provided with a liquid pump mechanism 16 and a liquid container 14. The liquid pump mechanism 16 is a mechanism which is provided with a pump which supplies (that is, pumps) the ink which is stored in the liquid container 14 to the first drive unit 21 in a pressurized state.

As illustrated in FIG. 10, the open-close valve V1 includes a valve seat 221, a valve body 222, a pressure receiving plate 223, and a spring 224. The valve seat 221 is a plate-shaped portion which partitions the space R1 and the space R2. A communication hole 230 which communicates the space R1 with the space R2 is formed in the valve seat 221. The pressure receiving plate 223 is a substantially circular plate member which is installed on the surface of the movable film 201 that faces the valve seat 221.

The valve body 222 surrounds a base portion 225, a valve shaft 226, and a sealing portion 227 (a seal). The valve shaft 226 vertically protrudes from the surface of the base portion 225, and the annular sealing portion 227 which surrounds the valve shaft 226 in plan view is installed on the surface of the base portion 225. The valve body 222 is disposed in the space R1 in a state in which the valve shaft 226 is inserted into the communication hole 230, and is biased to the valve seat 221 side by the spring 224. A gap is formed between the outer circumferential surface of the valve shaft 226 and the inner circumferential surface of the communication hole 230.

A bag-shaped body 240 is installed in the control chamber Rc. The bag-shaped body 240 is a bag-shaped member which is formed of an elastic material such as rubber, expands due to pressurization of the internal space, and contracts due to decompressing of the internal space.

The bag-shaped body 240 is connected to the pressure adjustment mechanism 18 via a degassing path 58 and the pressure adjustment port 69. The pressure adjustment mechanism 18 is capable of is selectively executing a pressurizing operation and a decompressing operation in accordance with an instruction from the control unit. The pressurizing operation supplies air to the degassing path 58 which is connected to the pressure adjustment mechanism 18, and a decompressing operation draws air from the degassing path 58. When the air is supplied from the pressure adjustment mechanism 18 to the internal space (that is, pressurizing), the bag-shaped body 240 expands, and the bag-shaped body 240 contracts due to the drawing of air by the pressure adjustment mechanism 18 (that is, decompression).

In a case in which the pressure inside the space R2 is maintained within a predetermined range in a state in which the bag-shaped body 240 is contracted, the sealing portion 227 closely adhered to the surface of the valve seat 221 due to the valve body 222 being biased by the spring 224. Therefore, the space R1 and the space R2 are blocked from each other. On the other hand, when the pressure in the space R2 is reduced to a value below a predetermined threshold due to ejection of the ink by the first drive unit 21 or drawing of air from the outside, the movable film 201 is displaced to the valve seat 221 side, and thus, the pressure receiving plate 223 presses against the valve shaft 226, and the sealing portion 227 is separated from the valve seat 221 due to the valve body 222 moving against the biasing by the spring 224. Therefore, the space R1 and the space R2 communicate with each other via the communication hole 230.

When the bag-shaped body 240 is expanded by the pressurization carried out by the pressure adjustment mechanism 18, the movable film 201 is displaced to the valve seat 221 side through the pressing of the bag-shaped body 240. Therefore, the valve body 222 moves due to the pressing by the pressure receiving plate 223, and the open-close valve V1 is released. In other words, regardless of whether the pressure in the space R2 is high or low, it is possible to forcibly release the open-close valve V1 using the pressurization carried out by the pressure adjustment mechanism 18.

When the open-close valve V1 of the valve mechanism 200 is released, the ink is supplied from the first supply flow path 51 to the common manifold 50 via the space R1, the space R2, and the second supply flow path 52.

As illustrated in FIG. 9, a filter 340 is provided between the common manifold 50 and the second supply flow path 52 in the flow path member 60. A degassing space Q is provided in the flow path member 60. The degassing space Q is a space in which the bubbles which are extracted from the ink are temporarily retained.

The filter 340 is installed so as to cross the second supply flow path 52 and collects bubbles and foreign matter which are mixed into the ink. Specifically, the filter 340 is installed so as to partition a space RF1 and a space RF2. The space RF1 of the upstream side communicates with the space R2 of the valve mechanism 200, and the space RF2 of the downstream side communicates with the common manifold 50.

A gas permeable film Mc is interposed between the space RF1 and the degassing space Q. Specifically, the ceiling surface of the space RF1 is formed of the gas permeable film Mc. The gas permeable film Mc is a gas permeable film body (a gas-liquid separation film) which allows a gas (air) to pass therethrough but does not allow a liquid such as the ink to pass therethrough, and, for example, is formed of a well-known polymer material. The bubbles which are collected by the filter 340 reach the ceiling surface of the space RF1 due to the rise due to buoyancy and are discharged to the degassing space Q by passing through the gas permeable film Mc. In other words, the bubbles which are mixed into the ink are separated.

The common manifold 50 is a space for temporarily storing the ink. The ink flows into the common manifold 50 from the second supply flow path 52 (the space RF2), and the ink flows into the manifolds 100 from the common manifold 50 via the inlet 144.

A gas permeable film MA is interposed between the common manifold 50 and the degassing space Q. Specifically, the ceiling surface of the common manifold 50 is formed of the gas permeable film MA. The gas permeable film MA is a gas permeable film body similar to the gas permeable film Mc which is described earlier. Therefore, the bubbles which pass through the filter 340 and enter the common manifold 50 rise due to buoyancy, pass through the gas permeable film MA of the ceiling surface of the common manifold 50, and are discharged into the degassing space Q.

The ink flows into the manifold 100 of the first drive unit 21 from the common manifold 50 via the inlet 144, as described earlier. The ink is supplied from the manifold 100 to the pressure chambers 112. The discharge port 145 is formed in the manifold 100. The discharge port 145 is a flow path which is formed in a ceiling surface 149 of the manifold 100. The ceiling surface 149 of the manifold 100 is an inclined surface (a flat surface or a curved surface) which rises toward the Z1 side in the third direction Z from the inlet 144 side to the discharge port 145 side.

Therefore, the bubbles which enter from the inlet 144 are guided along the ceiling surface 149 to the discharge port 145 side by the action of buoyancy. By providing a ceiling which has the ceiling surface 149 in the head unit 1 according to the present embodiment, it is possible to more reliably discharge the bubbles from the manifold 100 to the bubble return flow path 80. In FIG. 9, the ceiling surface 149 is raised along the second direction Y; however, the ceiling surface 149 may be raised along the first direction X.

A gas permeable film MB is interposed between the manifold 100 and the degassing space Q. The gas permeable film MB is a gas permeable film body similar to the gas permeable film MA and the gas permeable film Mc. Therefore, the bubbles which enter the discharge port 145 from the manifold 100 rise due to buoyancy, pass through the gas permeable film MB, and are discharged to the degassing space Q. As described above, since the bubbles inside the manifold 100 are guided along the ceiling surface 149 to the discharge port 145, it is possible to effectively discharge the bubbles inside the manifold 100 as compared with a configuration in which the ceiling surface 149 of the manifold 100 is a horizontal surface, for example. It is possible to form the gas permeable film MA, the gas permeable film MB, and the gas permeable film Mc using a single film body.

As described above, in the first embodiment, the gas permeable film MA is interposed between the common manifold 50 and the degassing space Q, the gas permeable film MB is interposed between the manifold 100 and the degassing space Q, and the gas permeable film Mc is interposed between the space RF1 and the degassing space Q. In other words, the bubbles which pass through each of the gas permeable film MA, the gas permeable film MB, and the gas permeable film Mc reach the common degassing space Q. Therefore, as compared to a configuration in which the bubbles which are extracted at the portions of the head unit 1 are supplied to separate spaces, there is an advantage in that the structure for discharging the bubbles is simplified.

The degassing space Q communicates with the degassing path 58. The degassing path 58 is a path for discharging air which is retained in the degassing space Q to the outside of the apparatus. The degassing path 58 of the present embodiment is provided with a first degassing path 55 and a second degassing path 56 which are provided in the flow path member 60. The first degassing path 55 is a flow path which communicates with the pressure adjustment port 69 which is provided in the Z1 side of the flow path member 60. The pressure adjustment port 69 is a cylindrical part to which the pressure adjustment mechanism 18 is connected. The first degassing path 55 splits part way, and one fork communicates with the control chamber Rc and the other fork communicates with the second degassing path 56.

The check valve V2 is provided in a region of the second degassing path 56 that faces the degassing space Q. The check valve V2 is a valve mechanism which permits the flow of air from the degassing space Q toward the degassing path 58 but inhibits the flow of air from the degassing path 58 to the degassing space Q.

As illustrated in FIG. 11, the check valve V2 surrounds a valve seat 341, a valve body 342, and a spring 343. The valve seat 341 is a plate-shaped portion which partitions the degassing space Q and the degassing path 58. A communication hole 330 which communicates the degassing space Q with the degassing path 58 is formed in the valve seat 341. The valve body 342 faces the valve seat 341 and is biased to the valve seat 341 side by the spring 343. In a state in which the pressure inside the degassing path 58 is maintained at a level greater than or equal to the pressure inside the degassing space Q (in a state in which the inside of the degassing path 58 is released to the atmosphere or is pressurized), the valve body 342 comes into close contact with the valve seat 341 due to the biasing from the spring 343, and thus, the communication hole 330 is blocked. Therefore, the degassing space Q and the degassing path 58 are blocked from each other. In a state in which the pressure inside the degassing path 58 falls below the pressure inside the degassing space Q (in a state in which the inside of the degassing path 58 is decompressed), the valve body 342 separates from the valve seat 341 against the biasing by the spring 343. Therefore, the degassing space Q and the degassing path 58 communicate with each other via the communication hole 330.

Description will be given of the configuration for discharging the bubbles from the manifold 100 using FIG. 9. As such a configuration, the bubble return flow path 80, the confluence point 85, the collective return flow path 88, and the one-way valve 400 are provided in the head unit 1 (the flow path member 60).

The bubble return flow path 80 is a flow path for communicating with the manifold 100 which is an example of a common liquid chamber and discharging the bubbles inside the manifold 100. In the present embodiment, the bubble return flow path 80 is provided with a first return flow path 81 and a second return flow path 82 which are formed in the flow path member 60.

The first return flow path 81 is an example of a bubble return flow path which communicates with the downstream side of the manifold 100. In the present embodiment, a portion at which the height of the ceiling surface 149 in the third direction Z is the highest is used as the downstream side of the manifold 100. The second return flow path 82 is a flow path for discharging the bubbles inside the common manifold 50 which is closer to the upstream side than the manifold 100. Two first return flow paths 81 are provided corresponding to each of the two manifolds 100, and the single second return flow path 82 is provided corresponding to the single common manifold 50. Naturally, a plurality of the first return flow paths 81 may be provided in relation to the single manifold 100, and a plurality of the second return flow paths 82 may be provided for the single common manifold 50.

The first return flow path 81 and the second return flow path 82 are an example of the bubble return flow path of an aspect of the invention, and the second return flow path 82 is an example of the upstream-side bubble return flow path of an aspect of the invention. The first return flow path 81 and the second return flow path 82 are also referred to collectively as the bubble return flow path 80.

The confluence point 85 is a portion which communicates with the plurality of bubble return flow paths 80. The collective return flow path 88 communicates with the confluence point 85 and is a flow path for discharging the bubbles inside the plurality of bubble return flow paths 80. In other words, the flow path closer to the side of the manifold 100 or the common manifold 50 than the confluence point 85 is the bubble return flow path 80, and the flow path close to the upstream side (the opposite side from the manifold 100 or the common manifold 50) than the confluence point 85 is the collective return flow path 88.

In the present embodiment, two of the confluence points 85 are provided in the flow path member 60. The collective return flow path 88 is formed of a flow path between the two confluence points 85 and a flow path from the confluence point 85 on one side (Y2 side) to the discharge port 68. The first return flow path 81 on the Y1 side is a flow path from the confluence point 85 on the Y1 side to the manifold 100, and the first return flow path 81 on the Y2 side is a flow path from the confluence point 85 on the Y2 side to the manifold 100. The second return flow path 82 is a flow path from the confluence point 85 on the Y1 side to the common manifold 50.

In the present embodiment, the three bubble return flow paths 80 merge at the two confluence points 85; however, the invention is not limited to such an aspect. For example, three of the bubble return flow paths 80 may merge at the single confluence point 85.

The discharge port 68 is provided on the surface on the Z1 side of the flow path member 60 and is a part to which the open-close valve 78, which is provided on the outer portion of the head unit 1, is connected. One end of the collective return flow path 88 communicates with the discharge port 68 and is connected to the open-close valve 78 via the discharge port 68. In an ordinary state, open-close valve 78 blocks the collective return flow path 88 (normally closed) and is a valve mechanism which is capable of temporarily releasing the collective return flow path 88 to the atmosphere.

The one-way valve 400 is provided part way down each of the bubble return flow paths 80. The one-way valve 400 is a valve mechanism which allows the ink (a liquid containing bubbles) to flow from the manifold 100 or the common manifold 50 to the outside (the open-close valve 78), but does not allow the ink to flow from the outside to the manifold 100 or the common manifold 50.

Figure 12:
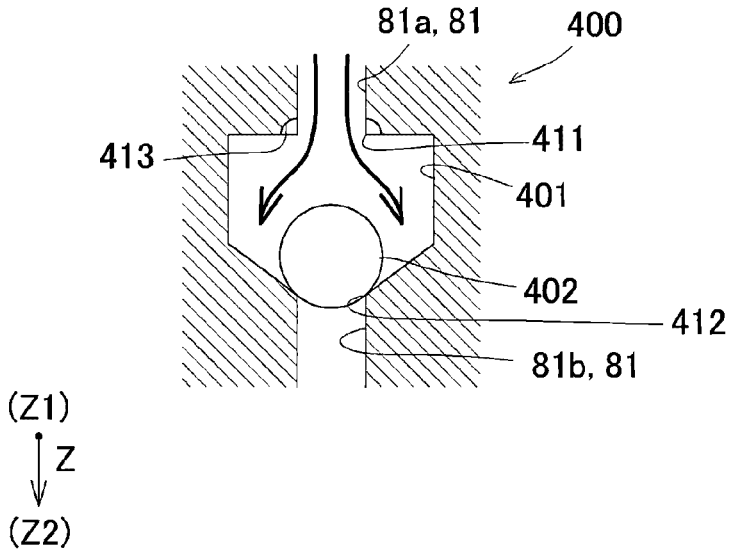
FIG. 12 is a sectional diagram illustrating the operation of a one-way valve.
Figure 13:
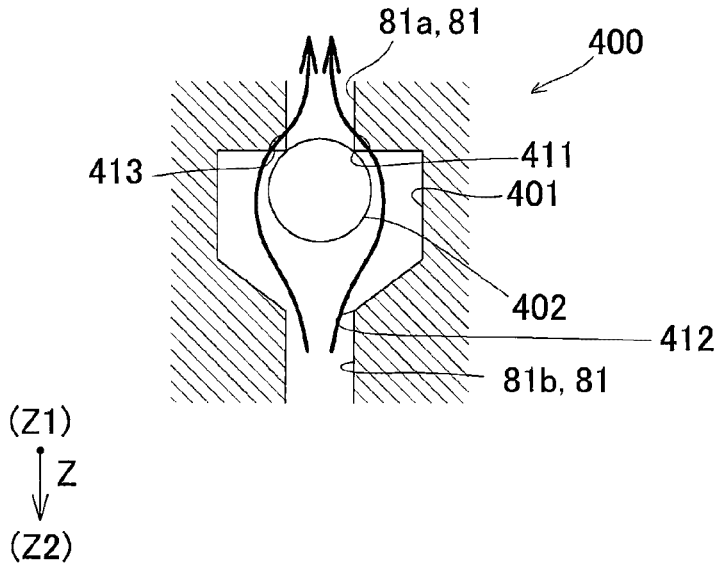
FIG. 13 is a sectional diagram illustrating the operation of the one-way valve.

Description will be given of a specific example of the one-way valve 400 using FIGS. 12 and 13. FIGS. 12 and 13 are sectional diagrams illustrating the operations of the one-way valve 400.

As illustrated in FIG. 12, the one-way valve 400 is provided with a valve chamber 401 which is formed part way down the first return flow path 81. A first opening portion 411 is opened in the top surface of the valve chamber 401 on the Z1 side. The first opening portion 411 is an opening on the downstream side (the opposite side from the manifold 100) of the first return flow path 81. A second opening portion 412 is opened in the bottom surface of the valve chamber 401 on the Z2 side. The second opening portion 412 is an opening on the upstream side (the manifold 100 side) of the first return flow path 81.

A spherical valve body 402 is disposed in the inner portion of the valve chamber 401. The diameters of the first opening portion 411 and the second opening portion 412 are formed to be smaller than the diameter of the valve body 402. A cutout portion 413 is formed in a portion of the first opening portion 411.

In the one-way valve 400 of this configuration, when the ink flows from the downstream side to the upstream side, the flow of the ink causes the valve body 402 to block the second opening portion 412. As a result, the ink does not flow from the downstream side to the upstream side.

As illustrated in FIG. 13, in the one-way valve 400, when the ink flows from the upstream side to the downstream side, the flow of the ink causes the valve body 402 to block the first opening portion 411. Since the cutout portion 413 is formed in a portion of the first opening portion 411, the ink passes through the cutout portion 413 and flows to the downstream side. As a result, it is possible for the ink to flow from the upstream side to the downstream side.

In FIGS. 12 and 13, description is given of the one-way valve 400 which is provided in the first return flow path 81; however, the one-way valve 400 which is provided in the second return flow path 82 is similar. The one-way valve 400 is not limited to the configuration which is described above, and any configuration may be used as long as the ink does not flow back to the manifold 100 side of the bubble return flow path 80.

Figure 14:
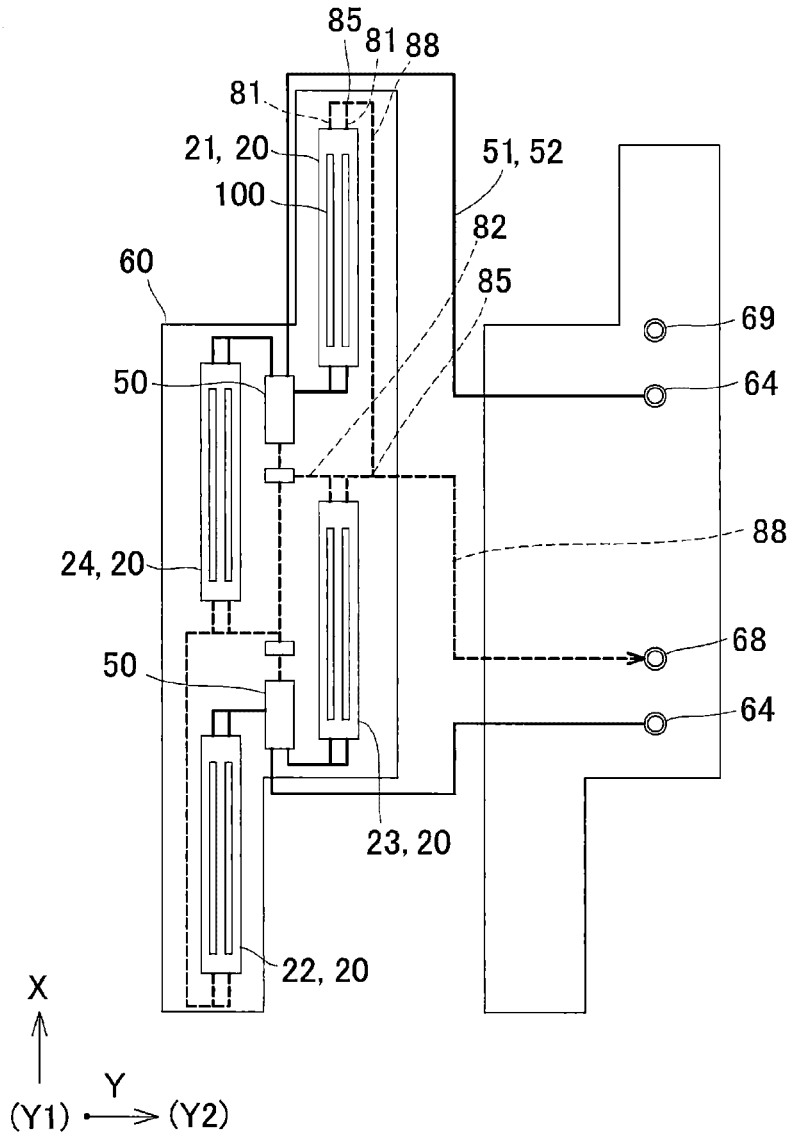
FIG. 14 is a plan view illustrating a flow path of an inner portion of the head unit.

Description will be given of the inlet 64 which supplies the ink to the manifold 100 and the discharge port 68 which discharges the ink from the collective return flow path 88 using FIG. 14. FIG. 14 is a plan view illustrating a flow path of an inner portion of the head unit, and is a plan view of the Z1 side of the head unit.

A total of four of the drive units 20, each of which includes two of the manifolds 100, are provided in the head unit 1 of the present embodiment. In relation to the to the drive units 20, two of the inlets 64 which serve as connecting ports which supply the ink are provided on the surface of the Z1 side of the head unit 1. A total of two of the common manifolds 50 are provided in the flow path member 60, one for every two of the drive units 20.

Each of the inlets 64 is connected to each of the common manifolds 50 via the first supply flow path 51 and the second supply flow path 52. The single common manifold 50 distributes the ink to the two drive units 20 (refer to FIG. 9). In the present embodiment, the single common manifold 50 distributes the ink to the first drive unit 21 and the fourth drive unit 24, and the other of the common manifolds 50 distributes the ink to the second drive unit 22 and the third drive unit 23.

On the other hand, in the head unit 1 of the present embodiment, the first return flow paths 81 of the drive units 20 merge at the confluence points 85 and communicate with the collective return flow path 88. The collective return flow path 88 is connected to the single discharge port 68.

In this manner, in the head unit 1 of the present embodiment, the number of the discharge ports 68 is 1, the number of the inlets 64 is 2, and the number of the discharge ports 68 is smaller than the number of the inlets 64. Since the number of the discharge ports 68 is smaller than the number of the inlets 64, it is possible to simplify the attachment and detachment between the head unit 1 and the supporting body 3 (the ink jet recording apparatus I). Hypothetically, if there is the same number of discharge ports 68 as the inlets 64, the hassle of attaching the connecting pipe 78*a* (refer to FIG. 1) to the discharge port 68 is increased.

The number of the inlets 64 is greater than that of the discharge ports 68. In other words, it is possible to independently provide at least the same number of flow paths from the inlets 64 to the manifold 100 as the number of the inlets 64. Therefore, it is possible to reduce the propagation of pressure fluctuations in the inner portion of a certain manifold 100 to the other manifolds via the flow path. Naturally, there is no specific constraint on the number of the inlets 64 and the discharge ports 68.

Figure 15:
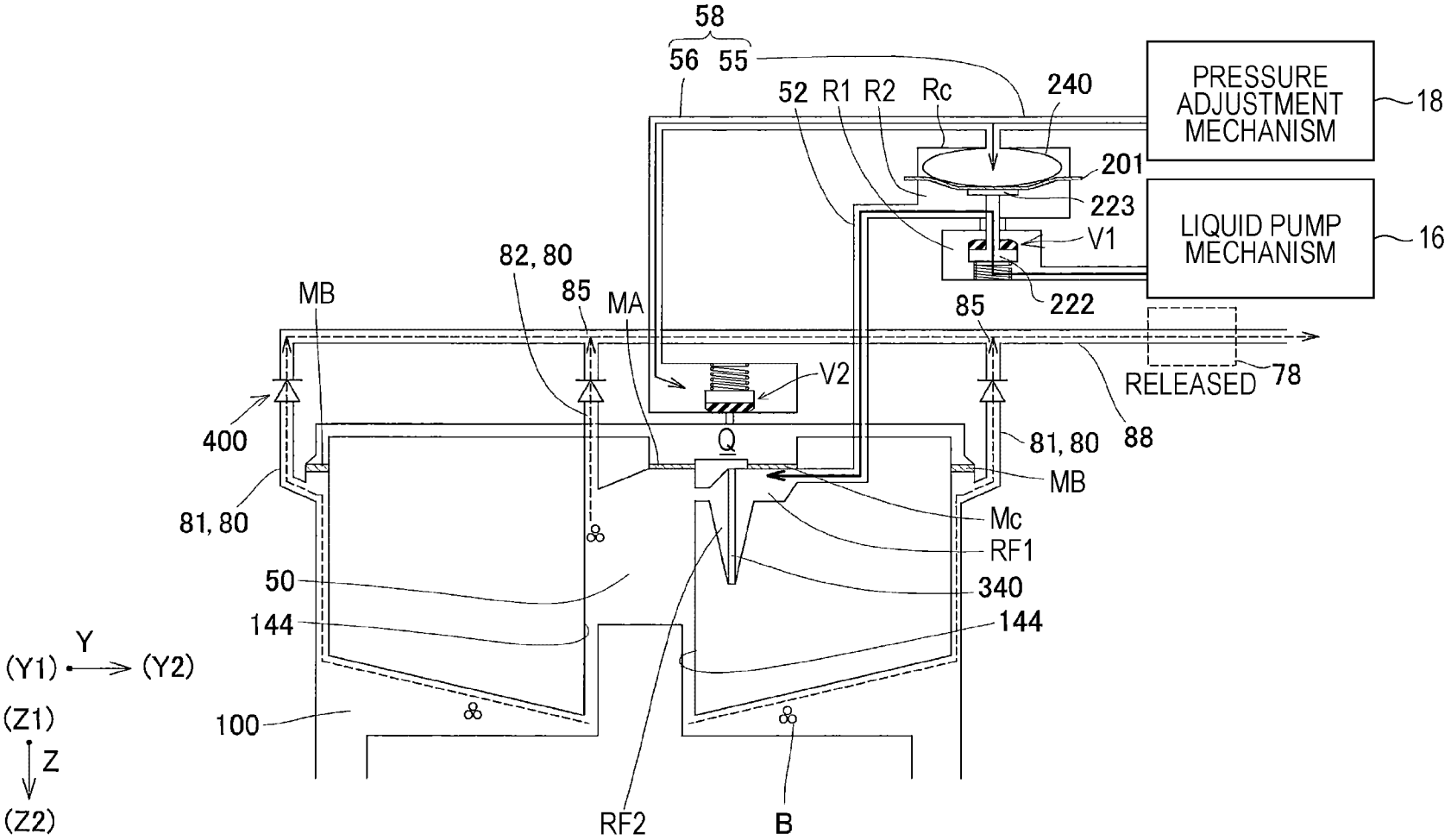
FIG. 15 is a schematic diagram of the head unit during an initial filling.
Figure 16:
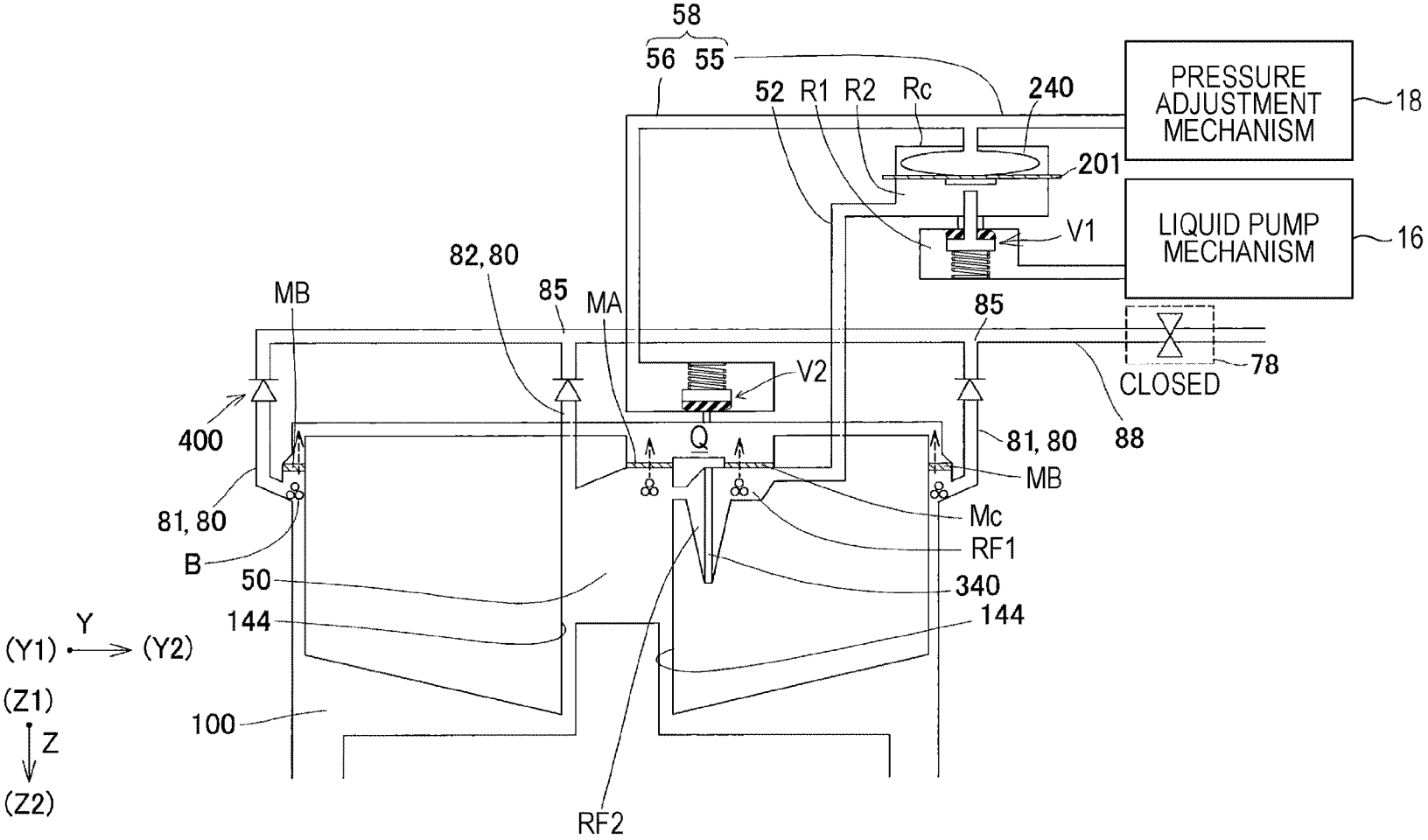
FIG. 16 is a schematic diagram of the head unit during ordinary usage.
Figure 17:
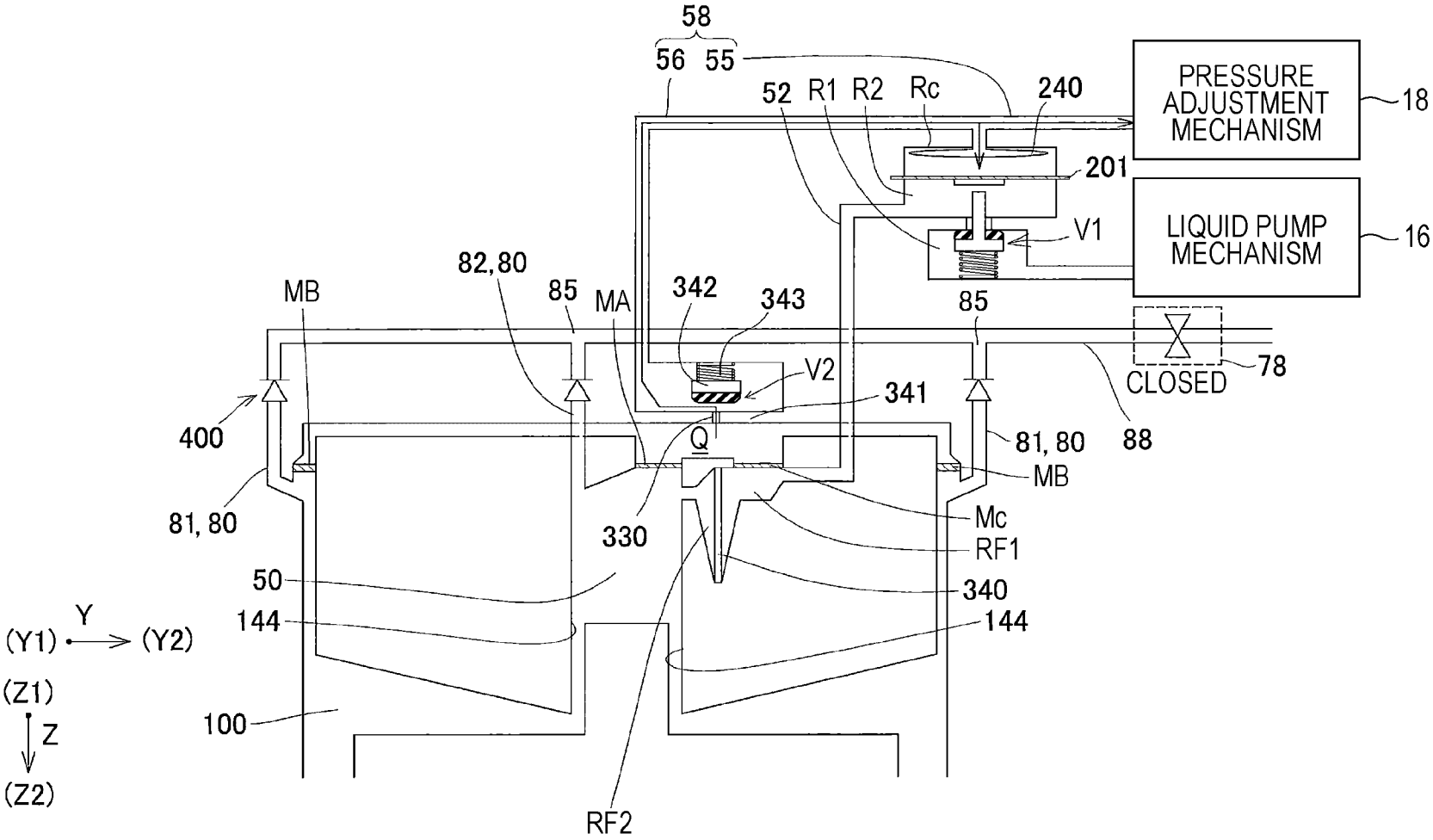
FIG. 17 is a schematic diagram of the head unit during a degassing operation.

Description will be given of the operations of the head unit 1 using FIGS. 15 to 17. FIG. 15 is a schematic diagram of the head unit 1 during an initial filling, FIG. 16 is a schematic diagram of the head unit 1 during ordinary usage, and FIG. 17 is a schematic diagram of the head unit 1 during a degassing operation.

As illustrated in FIG. 15, in a stage at which the head unit 1 is initially filled with the ink (hereinafter referred to as "initial filling"), the pressure adjustment mechanism 18 executes a pressurizing operation. In other words, the internal space the of the bag-shaped body 240 and the inside of the degassing path 58 are pressurized through the supply of air. Accordingly, the bag-shaped body 240 inside the control chamber Rc expands, the movable film 201 and the pressure receiving plate 223 are displaced, the valve body 222 moves due to the pressing from the pressure receiving plate 223, and the space R1 and the space R2 are communicated. In a state in which the degassing path 58 is pressurized, the degassing space Q and the degassing path 58 are blocked by the check valve V2, and thus the air inside the degassing path 58 does not flow into the degassing space Q. On the other hand, the open-close valve 78 is released at the stage of the initial filling.

In such an initial filling state, the liquid pump mechanism 16 pumps the ink which is stored in the liquid container 14 to the head unit 1. Specifically, the ink which is pumped from the liquid pump mechanism 16 is supplied to the common manifold 50 via the open-close valve V1 which is in the released state, and is supplied from the common manifold 50 to the manifold 100 and the pressure chambers 112 (refer to FIG. 9). Since the open-close valve 78 which is described above is released, together with the ink, the air which is present in the manifold 100 and the like and bubbles B in the ink pass through the first return flow path 81, the second return flow path 82, the collective return flow path 88, and the open-close valve 78 and are discharged to the outside of the ink jet recording apparatus I.

Accordingly, the entire flow path including the manifold 100 and the pressure chambers 112 of the head unit 1 is filled with the ink, and a state is assumed in which it is possible to eject the ink from the nozzle openings 25 through the operation of the piezoelectric actuator 160. As exemplified above, when the ink is pumped to the head unit 1 by the pump of the liquid pump mechanism 16, the open-close valve 78 is released so that it is possible to efficiently fill the flow path such as the manifold 100 of the head unit 1 with the ink. When the initial filling which is described above is completed, the pressurizing operation by the pressure adjustment mechanism 18 is stopped and the open-close valve 78 is closed.

In the head unit 1 according to the present embodiment, the minimum value of the flow path resistance of the flow path from the nozzle opening 25 via the bubble return flow path 80 to the open-close valve 78, which is the exit of the bubble return flow path 80, is smaller than the meniscus withstand pressure of the nozzle openings 25. In the present embodiment, the flow path is formed of the nozzle opening 25, the pressure chamber 112, the manifold 100, the first return flow path 81, the collective return flow path 88, the discharge port 68, and the connecting pipe 78*a*. The flow path resistance referred to here includes a pressure for opening the one-way valve 400.

In the head unit 1 of this configuration, when the initial filling of the ink is performed by pressurizing as described above, it is possible to reduce the amount of the ink which is discharged from the nozzle opening 25. This is because the pressure of the ink which flows through the flow path may be suppressed to be smaller than the meniscus withstand pressure by (the minimum value of) the flow path resistance of the flow path. In other words, the flow path is formed such that the pressure of the ink which flows through the flow path becomes smaller than the meniscus withstand pressure. Naturally, the minimum value of the flow path resistance may be greater than or equal to the meniscus withstand pressure of the nozzle opening 25.

As illustrated in FIG. 16, during ordinary usage after the completion of the initial filling, the bubbles B which are present in the manifold 100 or the like of the head unit 1 are discharged to the degassing space Q at all times. Specifically, the bubbles B inside the space RF1 are discharged to the degassing space Q via the gas permeable film Mc, the bubbles B inside the common manifold 50 are discharged to the degassing space Q via the gas permeable film MA, and the bubbles B inside the manifold 100 are discharged to the degassing space Q via the gas permeable film MB which is provided part way down the first return flow path 81. On the other hand, the open-close valve V1 is closed in a state in which the pressure in the space R2 is maintained within a predetermined range, and is released when the pressure in the space R2 falls below a predetermined threshold. When the open-close valve V1 is released, the ink which is pumped from the liquid pump mechanism 16 flows into the space R2 from the space R1, and as a result, the pressure in the space R2 rises, so that the open-close valve V1 is closed.

During the ordinary usage, the air which is retained in the degassing space Q is discharged to the outside of the apparatus by the degassing operation. The degassing operation may be executed at an arbitrary timing, for example, directly after the powering on of the ink jet recording apparatus I or during a printing operation.

As illustrated in FIG. 17, in the degassing operation of the head unit 1, the pressure adjustment mechanism 18 executes a decompressing operation. In other words, the internal space of the bag-shaped body 240 and the degassing path 58 are decompressed through the drawing of air.

When the degassing path 58 is decompressed, the valve body 342 of the check valve V2 separates from the valve seat 341 against the biasing force of the spring 343, and the degassing space Q and the degassing path 58 communicate with each other via the communication hole 330. Therefore the air inside the degassing space Q is discharged to the outside of the ink jet recording apparatus I via the degassing path 58. On the other hand, although the bag-shaped body 240 contracts due to the decompression of the internal space, since the pressure in the control chamber Rc (and consequently the movable film 201) is not influenced, the open-close valve V1 is maintained in a closed state.

Here, description will be given of the operation of the one-way valve 400 during ordinary usage using FIG. 9. During the ordinary usage, the bubbles which are contained in the ink of the manifold 100 are mainly discharged into the degassing space Q via the gas permeable film MB. A portion of the bubbles which are contained in the ink of the manifold 100 passes through the one-way valve 400, passes from the first return flow path 81, exceeds the confluence point 85, and is capable of reaching the first return flow path 81 which communicates with the other manifold 100.

Here, in a head unit which is hypothetically configured such that the one-way valve 400 is not provided in each of the bubble return flow paths 80, the bubbles which exceed the confluence point 85 from a certain bubble return flow path 80 are not only discharged together with ink to the open-close valve 78, but a portion of the bubbles may flow back into the manifold 100 and the common manifold 50 via another bubble return flow path 80, which may cause defective ejection of the ink. In particular, in a case in which the ink is ejected from the nozzle openings 25 which communicate with one manifold 100 and the ink is hardly ejected from the nozzle openings 25 which communicate with the other manifold 100, there is a high possibility that such back flow will occur.

However, in the head unit 1 of the present embodiment, since the one-way valve 400 is provided in each of the first return flow paths 81, it is possible to suppress the flowing back of the bubbles which are discharged from the each of the manifolds 100 to the other manifolds 100. Similarly for the second return flow path 82, since the one-way valve 400 is provided, it is possible to suppress the flowing back of the bubbles from each of the manifolds 100 to the common manifold 50 via the second return flow path 82.

The ink jet recording apparatus I which is provided with the head unit 1 is capable of discharging the bubbles which are discharged from the manifold 100 to the outside without allowing the bubbles to flow back to the other manifolds 100, and is capable of suppressing the defective ejection of the ink.

In the head unit 1 of the present embodiment, since the confluence point 85 is provided in the head unit 1 (in the flow path member 60), it is possible to reduce the size of the head unit 1 as compared with a configuration in which the confluence point 85 is provided outside of the head unit 1

(for example, a separate member from the flow path member 60). Since the plurality of bubble return flow paths 80 are unified into the collective return flow path 88 and are connected to the open-close valve 78 of the ink jet recording apparatus I, when attaching to and detaching from the ink jet recording apparatus I, the connection with the open-close valve 78 becomes easy.

The ink which flows from the collective return flow path 88 to the open-close valve 78 and the bubbles contained in the ink may be discarded or may be returned to the liquid supply unit 4.

In the head unit 1 according to the present embodiment, the gas permeable film MB is provided part way down the bubble return flow path 80 as an example of a gas permeable portion. By providing the gas permeable film MB, the bubbles in the ink which enters the bubble return flow path 80 pass through the gas permeable film MB and are discharged to the outside via the degassing space Q. In this manner, bubbles in the ink are discharged together with the ink via the collective return flow path 88, but the ink and the bubbles are also caused to permeate through the gas permeable film MB to discharge only the bubbles to the outside, and it is possible to more reliably discharge the bubbles inside the manifold 100 to the outside.

The head unit 1 according to the present embodiment is provided with the second return flow path 82 which communicates with the common manifold 50. It is possible to discharge the bubbles which are contained in the ink inside the common manifold 50 together with the ink from the open-close valve 78 to the outside using the second return flow path 82.

The head unit 1 according to the present embodiment may perform a cleaning operation for forcibly discharging the bubbles inside the manifold 100 together with ink. The cleaning operation is carried out under the instruction of the control unit at an arbitrary timing. Specifically, by pressurizing the ink inside the manifold 100 and discharging the ink from the nozzle opening 25 using the liquid pump mechanism 16, so-called pressure cleaning is performed. During the pressurized cleaning, the open-close valve 78 is closed and the cleaning is performed.

In this manner, since the open-close valve 78 is closed during the pressurized cleaning, since it is possible to discharge the pressurized ink to only the nozzle opening 25 without discharging the pressurized ink from the collective return flow path 88 to the outside of the open-close valve 78, it is possible to effectively discharge the ink from the nozzle opening 25 and to effectively carry out the pressurized cleaning. During the pressurized cleaning, the open-close valve 78 may be released.

Other Embodiment

Each of the embodiments of the invention are described above; however, the basic configuration of the invention is not limited to the above.

In the head unit 1 according to the first embodiment, the gas permeable film MB is provided part way down the bubble return flow path 80; however, the invention is not limited to such an aspect, and the gas permeable film MB may not be provided.

In the head unit 1 of the first embodiment, the ceiling of the manifold 100 includes the inclined ceiling surface 149; however, the invention is not limited to such an aspect, and the ceiling of the manifold 100 may be a ceiling surface substantially parallel to the nozzle surface 20*a*, and may be another arbitrary shape.

In the head unit 1 of the first embodiment, the second return flow path 82 is provided in the common manifold 50; however, the invention is not limited to such an aspect, and the second return flow path 82 may not be provided.

During the initial filling, the head unit 1 of the first embodiment opens the open-close valve 78 to discharge the bubbles via the bubble return flow path 80, and closes the open-close valve 78 after the initial filling; however, the invention is not limited to such an aspect.

In the head unit 1 of the first embodiment, the check valve V2 is provided in the second degassing path 56; however, the check valve V2 may not be provided. Since the pressurizing operation of the pressure adjustment mechanism 18 is performed in a short time as compared with the decompressing operation, even if the pressure adjustment mechanism 18 performs the pressurizing operation, the air in the degassing space Q does not easily pass through the gas permeable film MA and the gas permeable film Mc.

In the embodiment which is described above, a so-called line recording apparatus in which the head unit 1 is fixed to the apparatus main body 7 and printing is performed only by transporting the recording sheet S is exemplified as the ink jet recording apparatus I; however, the embodiment is not particularly limited thereto, and for example, it is possible to apply the invention to a so-called serial recording apparatus in which the head unit 1 is mounted on a supporting body such as a carriage that moves in the first direction X which intersects the second direction Y, which is the transport direction of the recording sheet S, and printing is performed while moving the head unit 1 in the first direction X together with the supporting body.

In the embodiments which are described above, the ink jet recording head unit is given as an example of the liquid ejecting head unit, and an ink jet recording apparatus is given as an example of the liquid ejecting apparatus; however, the invention is widely targeted at liquid ejecting head units and liquid ejecting apparatuses in general, and naturally, it is possible to apply the invention to a liquid ejecting head unit or a liquid ejecting apparatus which ejects a liquid other than the ink. Examples of other liquid ejecting heads include a variety of recording head units which are used in an image recording apparatus such as a printer, color material ejecting head units which are used in the manufacture of color filters of liquid crystal displays and the like, electrode material ejecting head units which are used to form electrodes such as organic EL displays, field emission displays (FED) and the like, and biological organic substance ejecting head units which are used in the manufacture of biochips. It is possible to apply the other liquid ejecting heads to a liquid ejecting apparatus which is provided with the liquid ejecting head unit.

What is claimed is:

1. A liquid ejecting head unit comprising:

a drive unit for ejecting a liquid inside a pressure chamber from a nozzle opening which communicates with the pressure chamber;

a common liquid chamber which communicates with a plurality of the pressure chambers;

a bubble return flow path for communicating with the common liquid chamber and discharging bubbles inside the common liquid chamber;

a confluence point which communicates with a plurality of the bubble return flow paths, the plurality of bubble return paths each having a separate connection to the common liquid chamber and communicating with each other at the confluence point;

a collective return flow path for communicating with the confluence point and discharging the bubbles inside the plurality of bubble return flow paths; and a one-way valve which is provided at the bubble return flow path.

2. The liquid ejecting head unit according to claim 1, further comprising:

a gas permeable portion which is provided at the bubble return flow path, allows gas to permeate, and does not allow a liquid to permeate.

3. A liquid ejecting apparatus comprising:

the liquid ejecting head unit according to claim 2; and a valve which communicates the collective return flow path with the atmosphere in an open state and blocks the collective return flow path in a closed state.

4. The liquid ejecting apparatus according to claim 3, further comprising:

a pump configured to pressurize an inside of the common liquid chamber, wherein the valve is closed when discharging a liquid inside the common liquid chamber from the nozzle opening using the pump.

5. The liquid ejecting apparatus according to claim 4, wherein during an initial filling, the valve is opened, and bubbles are discharged via the bubble return flow path, and wherein after the initial filling, the valve is closed.

6. The liquid ejecting head unit according to claim 1, wherein a ceiling of the common liquid chamber is inclined toward the bubble return flow path.

7. A liquid ejecting apparatus comprising:

the liquid ejecting head unit according to claim 6; and a valve which communicates the collective return flow path with the atmosphere in an open state and blocks the collective return flow path in a closed state.

8. The liquid ejecting apparatus according to claim 7, further comprising:

a pump configured to pressurize an inside of the common liquid chamber, wherein the valve is closed when discharging a liquid inside the common liquid chamber from the nozzle opening using the pump.

9. The liquid ejecting apparatus according to claim 8, wherein during an initial filling, the valve is opened, and bubbles are discharged via the bubble return flow path, and wherein after the initial filling, the valve is closed.

10. The liquid ejecting head unit according to claim 1, further comprising:

an upstream side bubble return flow path for communicating with the common liquid chamber and discharging bubbles inside an upstream flow path which is closer to an upstream side than the common liquid chamber, wherein the confluence point communicates with the upstream side bubble return flow path.

11. A liquid ejecting apparatus comprising:

the liquid ejecting head unit according to claim 10; and a valve which communicates the collective return flow path with the atmosphere in an open state and blocks the collective return flow path in a closed state.

12. The liquid ejecting apparatus according to claim 11, further comprising:

a pump configured to pressurize an inside of the common liquid chamber, wherein the valve is closed when discharging a liquid inside the common liquid chamber from the nozzle opening using the pump.

13. The liquid ejecting apparatus according to claim 12, wherein during an initial filling, the valve is opened, and bubbles are discharged via the bubble return flow path, and wherein after the initial filling, the valve is closed.

14. The liquid ejecting head unit according to claim 1, wherein a minimum value of flow path resistance of a flow path from the nozzle opening to an exit via the bubble return flow path is smaller than a meniscus withstand pressure of the nozzle opening.

15. A liquid ejecting apparatus comprising:

the liquid ejecting head unit according to claim 14; and a valve which communicates the collective return flow path with the atmosphere in an open state and blocks the collective return flow path in a closed state.

16. The liquid ejecting apparatus according to claim 15, further comprising:

a liquid pump mechanism which pressurizes an inside of the common liquid chamber, wherein the valve is closed when discharging a liquid inside the common liquid chamber from the nozzle opening using the liquid pump mechanism.

17. A liquid ejecting apparatus comprising:

the liquid ejecting head unit according to claim 1; and a valve which communicates the collective return flow path with atmosphere in an open state and blocks the collective return flow path in a closed state.

18. The liquid ejecting apparatus according to claim 17, further comprising:

a pump configured to pressurize an inside of the common liquid chamber, wherein the valve is closed when discharging a liquid inside the common liquid chamber from the nozzle opening using the pump.

19. The liquid ejecting apparatus according to claim 18, wherein during an initial filling, the valve is opened, and bubbles are discharged via the bubble return flow path, and wherein after the initial filling, the valve is closed.

20. The liquid ejecting apparatus according to claim 17, wherein the liquid ejecting head unit further includes an inlet which is connected to a liquid supply unit which is provided in the liquid ejecting apparatus and introduces a liquid into the common liquid chamber, and a discharge port which is connected to the valve, which is provided in the liquid ejecting apparatus and communicates with the collective return flow path, and discharges the liquid from the collective return flow path, and wherein a number of the discharge ports is smaller than a number of the inlets.

* * * * *